US011033048B2

(12) United States Patent
Ajithkumar et al.

(10) Patent No.: US 11,033,048 B2
(45) Date of Patent: Jun. 15, 2021

(54) HOMOGENIZED TOBACCO MATERIAL AND METHOD OF PRODUCTION OF HOMOGENIZED TOBACCO MATERIAL

(71) Applicant: PHILIP MORRIS PRODUCTS S.A., Neuchatel (CH)

(72) Inventors: Anu Ajithkumar, Neuchatel (CH); Johannes Petrus Maria Pijnenburg, Neuchatel (CH); Esther Wairimu, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 215 days.

(21) Appl. No.: 15/557,874

(22) PCT Filed: Apr. 1, 2016

(86) PCT No.: PCT/EP2016/057275

§ 371 (c)(1),
(2) Date: Sep. 13, 2017

(87) PCT Pub. No.: WO2016/156598

PCT Pub. Date: Oct. 6, 2016

(65) Prior Publication Data

US 2018/0049465 A1 Feb. 22, 2018

(30) Foreign Application Priority Data

Apr. 1, 2015 (EP) ..... 15162260

(51) Int. Cl.
*A24B 15/14* (2006.01)
*A24B 15/20* (2006.01)
*A24B 15/24* (2006.01)

(52) U.S. Cl.
CPC ..... *A24B 15/14* (2013.01); *A24B 15/20* (2013.01); *A24B 15/241* (2013.01)

(58) Field of Classification Search
None
See application file for complete search history.

(56) References Cited

U.S. PATENT DOCUMENTS 4,306,578 A 12/1981 Schmidt
4,874,000 A * 10/1989 Tamol ..... A24B 3/14 131/375

(Continued)

FOREIGN PATENT DOCUMENTS

CN 102762118 10/2012
CN 103153098 6/2013

(Continued)

OTHER PUBLICATIONS

PCT/EP2016057275 International Search Report and Written Opinion dated Jun. 15, 2016 (13 pages).

(Continued)

*Primary Examiner* — Michael H. Wilson
*Assistant Examiner* — Katherine A Will
(74) *Attorney, Agent, or Firm* — Mueting Raasch Group

(57) ABSTRACT

The invention relates to a method for the preparation of a homogenized tobacco material, said method comprising: —pulping and refining cellulose fibres to obtain fibres having a mean size per weight comprised between about 0.2 millimetres and about 4 millimetres; —grinding a blend of tobacco of one or more tobacco types to tobacco particles having a mean size per weight comprised between about 0.03 millimetres and about 0.12 millimetres; —Combining the cellulose fibres with the tobacco particles and with a binder to form a slurry; —homogenizing the slurry; —adding asparaginase to the slurry; and—forming the homogenized tobacco material from the slurry, wherein the homogenized tobacco material comprises from about 1 percent and about 5 percent in dry weight basis of the binder.

14 Claims, 11 Drawing Sheets

(56) References Cited

U.S. PATENT DOCUMENTS

| | | | | |
|---|---|---|---|---|
| 8,863,375 | B2 | 10/2014 | Ajithkumar | |
| 8,944,072 | B2 | 2/2015 | Chen | |
| 9,439,451 | B2 | 9/2016 | Volgger | |
| 2011/0048434 | A1 | 3/2011 | Chen | |
| 2012/0006343 | A1* | 1/2012 | Renaud ..... | A24B 15/12<br>131/280 |

FOREIGN PATENT DOCUMENTS

| | | |
|---|---|---|
| EP | 2617299 | 7/2013 |
| GB | 815315 | 6/1959 |
| GB | 961866 | 6/1964 |
| JP | 54-140798 | 11/1979 |
| JP | 2013-519384 | 5/2013 |
| JP | 2013-532994 | 8/2013 |
| WO | WO 2011/101164 | 8/2011 |
| WO | WO 2012/021683 | 2/2012 |

OTHER PUBLICATIONS

Office Action issued in China for Application No. 201680014255.0 dated Sep. 3, 2019 (34 pages). English translation included.
Office Action issued in China for Application No. 201680014255.0 dated Feb. 3, 2020 (23 pages). English translation included.
Office Action issued in Japan for Application No. 2017-546615 dated Mar. 23, 2020 (24 pages). English translation included.

* cited by examiner

HOMOGENIZED TOBACCO MATERIAL AND METHOD OF PRODUCTION OF HOMOGENIZED TOBACCO MATERIAL

This application is a U.S. National Stage Application of International Application No. PCT/EP2016/057275, filed Apr. 1, 2016, which was published in English on Oct. 6, 2016, as International Publication No. WO 2016/156598. International Application No. PCT/EP2016/057275 claims priority to European Application No, 15162260.2 filed Apr. 1, 2015.

This invention relates to a homogenized tobacco material and to a process for producing it. The invention also relates to the use of the homogenized tobacco material in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles, in particular aerosol-generating article.

Homogenized tobacco material that is intended for use as an aerosol-forming substrate of a heated aerosol-generating article of the "heat-not-burn" type tends to have a different composition to homogenized tobacco intended for use as filler in conventional cigarettes. In a heated aerosol-generating article, an aerosol-forming substrate is heated to a relatively low temperature, in order to form an aerosol. The homogenized tobacco material is typically the only tobacco source, or the main tobacco source, present in the aerosol-generating article.

It may be desired to minimize the quantity of acrylamide present in the homogenized tobacco material and in the aerosol produced therefrom when heated. Acrylamide is a chemical compound with the chemical formula $C_3H_5NO$. Its IUPAC name is prop-2-enamide. Concerns have been raised regarding its potential toxicity.

During the production of aerosol generating articles comprising homogenized tobacco material from a homogenized tobacco material web, the homogenized tobacco web is typically required to withstand some physical handling like for example, wetting, conveying, drying and cutting. It would be therefore desirable to provide a homogenized tobacco web that is adapted to withstand such handling with no or minimal impact on the quality of the final tobacco material. In particular, it would be desirable, that the homogenized tobacco material web shows little complete or partial ripping. A ripped homogenized tobacco web could lead to the loss of tobacco material during manufacture. Also, a partially or completely ripped homogenized tobacco web may lead to machine downtime and waste during machine stops and ramp up.

Therefore, there is a need for a new method of preparing a homogenized tobacco web for the use in heated aerosol-generating articles of the "heat-not-burn" type that is adapted to the different heating characteristics and aerosol forming needs of such a heated aerosol-generating article which at the same time lowers the content of acrylamide with comparison to the known homogenized tobacco material. Such a homogenized tobacco web should further be adapted to withstand the required manufacturing processes.

According to a first aspect, the invention relates to a method for the production of a homogenized tobacco material. The method includes the steps of pulping and refining cellulose fibres so as to form a pulp and grinding a blend of tobacco of one or more tobacco types. In a further step, a slurry is formed by combining the tobacco particles of different tobacco types with the cellulose fibres and a binder. Asparaginase is further added to the slurry. A further step comprises homogenizing the slurry, and forming a homogenized tobacco material from the slurry. According to the invention, the pulping and refining step outputs cellulose fibres having a mean size between about 0.2 millimetres and about 4 millimetres. The grinding step produces tobacco particles having a mean size per weight comprised between about 0.03 millimetres and about 0.12 millimetres. The binder is added in the slurry in an amount between about 1 percent and about 5 percent in dry weight basis.

According to a second aspect, the invention relates to a method for the production of a homogenized tobacco material. The method includes the steps of pulping and refining cellulose fibres so as to form a pulp and grinding a blend of tobacco of one or more tobacco types. In a further step, a slurry is formed by combining the tobacco blend particles of different tobacco types with the cellulose fibres and a binder. Asparaginase is further added to the slurry. A further step comprises homogenizing the slurry, and forming a homogenized tobacco material from the slurry. According to the invention, the pulping and refining step outputs cellulose fibres having a mean size between about 0.2 millimetres and about 4 millimetres. The grinding step produces tobacco particles having a mean size per weight comprised between about 0.03 millimetres and about 0.12 millimetres. The tobacco particles are added in an amount comprised between about 50 percent and about 93 percent in dry weight basis.

The term "homogenized tobacco material" is used throughout the specification to encompass any tobacco material formed by the agglomeration of particles of tobacco material. Sheets or webs of homogenized tobacco may be formed in the present invention by agglomerating particulate tobacco obtained by grinding or otherwise powdering of one or both of tobacco leaf lamina and tobacco leaf stems.

Homogenized tobacco material may comprise a minor quantity of one or more of tobacco dust, tobacco fines, and other particulate tobacco by-products formed during the treating, handling and shipping of tobacco.

The tobacco present in the homogenized tobacco material may constitutes the majority of the tobacco, or even substantially the total amount of tobacco present in the aerosol-generating article. The impact on the characteristics of the aerosol, such as its flavour, may derive predominantly from the homogenized tobacco material. It is preferred that the release of substances from the tobacco present in the homogenized tobacco material is simplified, in order to optimize use of tobacco. At least a fraction of the tobacco particles may have a particle of the same size or below the size of the tobacco cell structure. It is believed that fine grinding tobacco to about 0.05 millimetres can advantageously open the tobacco cell structure and in this way the aerosolization of tobacco substances from the tobacco itself may be improved. Such Tobacco substances may include pectin, nicotine, essential oils and other flavours. In the following, the term "tobacco powder" or "tobacco particles" is used through the specification to indicate tobacco having a mean size per weight between about 0.03 millimetres and about 0.12 millimetres.

Tobacco particles having a mean particle size by weight between about 0.03 millimetres and about 0.12 millimetres may improve the homogeneity of the slurry. Too big tobacco particles, that is tobacco particles bigger than about 0.15 millimetres, may be the cause of defects and weak areas in the homogenized tobacco web which is formed from the slurry. Defects in the homogenized tobacco web may reduce the tensile strength of the homogenized tobacco web. A reduced tensile strength may lead to difficulties in subsequent handling of the homogenized tobacco web in the production of the aerosol-generating article and could for example cause machine stops. Additionally, an inhomogeneous tobacco web may create unintended difference in the aerosol delivery between aerosol generating articles that are produced from the same homogenized tobacco web. Therefore, preferably a tobacco having relatively small mean particle size is desired as a starting tobacco material to form the slurry to obtain acceptable homogenized tobacco material for aerosol-generating articles. Too small tobacco particles may increase the energy consumption required in the process for their size reduction without adding advantages for this further reduction.

A reduced tobacco particles mean size may also be beneficial due to its effect on reducing the viscosity of the tobacco slurry, thereby allowing a better homogeneity. However, at the size between about 0.03 millimetres and about 0.12 millimetres, the tobacco cellulose fibres within the tobacco material may be substantially destroyed. Therefore, the tobacco cellulose fibres within the tobacco material may have only a very small contribution to the tensile strength of the resulting homogenized tobacco web. Conventionally, this may be compensated by the addition of binders. Nevertheless, there may be a practical limit to the amount of binders that may be present in the slurry and hence in the homogenized tobacco material. This is due to the tendency of the binders to gel when coming in contact with water. Gelling strongly influences the viscosity of the slurry, which in turn is an important parameter of the slurry for subsequent web manufacturing processes, like for example casting. It is therefore typically preferred to have a relatively low amount of binder in the homogenized tobacco material. According to the first aspect of the invention, the quantity of binder added to the blend of one or more tobacco types is comprised between about 1 percent and about 5 percent in dry weight of the slurry. The binder used in the slurry may be any of the gums or pectins described herein. The binder may ensure that the tobacco powder remains substantially dispersed throughout the homogenized tobacco web. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Although on one hand the relatively small tobacco particles mean size and the reduced amount of binder may result in a very homogeneous slurry and then in a very homogeneous homogenized tobacco material, on the other hand the tensile strength of the homogenized tobacco web obtained from this slurry may be relatively low and potentially insufficient to adequately withstand the forces acting on the homogenized tobacco material during processing.

Cellulose fibres are introduced in the slurry. The introduction of cellulose fibres in the slurry typically increases the tensile strength of the tobacco material web, acting as a strengthening agent. Therefore, adding cellulose fibres may increase the resilience of the homogenized tobacco material web. This may support a smooth manufacturing process and subsequent handling of the homogenized tobacco material during the manufacture of aerosol generating articles. In turn, this may lead to an increase in production efficiency, cost efficiency, reproducibility and production speed of the manufacture of the aerosol-generating articles and other smoking articles.

Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof.

Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo.

One relevant factor in the cellulose fibres is the cellulose fibre length. Where the cellulose fibres are too short, the fibres would not contribute efficiently to the tensile strength of the resulting homogenized tobacco material. Where the cellulose fibres are too long, the cellulose fibres would impact the homogeneity in the slurry and in turn may create inhomogeneties and other defects in the homogenized tobacco material, in particular for thin homogenized tobacco material, for example with a homogenized tobacco material with a thickness of several hundreds of micrometres. According to the first aspect of the invention, in a slurry comprising tobacco particles having a mean size per weight between about 0.03 millimetres and about 0.12 millimetres and a quantity of binder between about 1 percent and about 5 percent in dry weight of the slurry, the length of cellulose fibres is advantageously between about 0.2 millimetres and about 4 millimetres. Preferably, the mean length per weight of the cellulose fibres is between about 1 millimetre and about 3 millimetres. Preferably, this further reduction is obtained by means of a refining step. In the present specification, the fibre length means the dominant dimension of the fibre. Further, preferably, according to the invention, the amount of the cellulose fibres is comprised between about 1 percent and about 7 percent in dry weight basis of the total weight of the slurry. These values of the ingredients of the slurry have shown to improved tensile strength while maintaining a high level of homogeneity of the homogenized tobacco material compared to homogenized tobacco material that only relies on binder to address tensile strength of the homogeneous tobacco web. At the same time, cellulose fibres having a mean size between about 0.2 millimetres and about 4 millimetres do not significantly inhibit the release of substances from the fine ground tobacco powder when the homogenized tobacco material is used as an aerosol generating substrate of an aerosol generating article. According to the invention, a relatively fast and reliable manufacturing process of homogenized tobacco web can be obtained, as well as a substrate that is adapted to release a highly reproducible aerosol.

The method of the invention comprises the addition of Asparaginase. Asparaginase is an enzyme that catalyzes the hydrolysis of asparagine to aspartic acid, according to the following reaction:

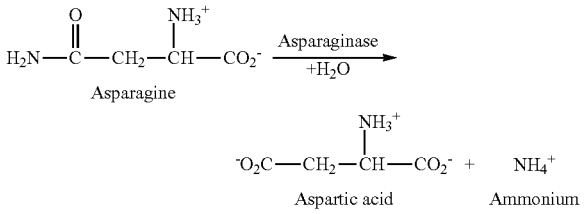

Asparaginases are enzymes expressed and produced by microorganisms, such as archaea, fungi, etc., and can be natural derived or recombinantly produced by and from such organisms. Microorganism sources include among others *Saccharomyces cerevisiae, Erwinia carotovora, Escherichia coli, Aspergillus oryzae, A. niger, Erwinia chrysanthemi* and *Enterobacteraerogenes*.

Asparaginase or Colaspase is classified EC 3.5.1.1 in Enzyme Commission number (EC number), which is a numerical classification scheme for enzymes, based on the chemical reactions they catalyze. Asparaginase is commercially available from—for example—Megazyme (ASNEC, *E. coli* derived) and Novozyme (Acrylaway®).

The amount of acrylamide in the aerosol produced by heating the homogenized tobacco material according to the invention including asparaginase can be drastically reduced. The inventors believe that is due to the addition of asparaginase following the method of the invention.

It has also been discovered that the addition of the asparaginase enzyme in the slurry could also have a limited impact on the taste and the overall smoking experience of the user heating the homogenized tobacco material so obtained. Elements that contribute to form the taste and the smoking sensation of the user may include—among others—the amount of nicotine, of reducing sugars, of $NO_3$ and of total alkaloids both in the homogenized tobacco material and in the aerosol formed heating the homogenized tobacco material. All these elements are not substantially modified by the addition of asparaginase in the slurry and the derived transformation of asparagine into aspartic acid and ammonia. Further, characteristics for the production of a "good" aerosol, that is, aspects of the slurry which are important for the production of an aerosol when the homogenized tobacco material is heated, such as the moisture of the slurry before casting and the amount of aerosol-forming material or humectant, such as glycerol, are not substantially altered by the addition of asparaginase as well. Smoking articles produced using a portion of the homogenized tobacco material produced according to the invention are preferably not significantly altered by the addition of asparaginase and the taste and other sensory aspects for the user are significantly not changed.

Advantageously, according to the second aspect of the invention or as a further characteristic of the first aspect, the homogenized tobacco material comprises between about 50 percent and about 93 percent in dry weight basis of tobacco particles. The amount of the tobacco blend is comprised between about 50 percent and about 93 percent per weight on dry weight basis of the homogenized tobacco material, which is a relatively "high" concentration. Most of the homogenized tobacco material is formed by the tobacco blend. Although there is such a high concentration of tobacco, and therefore of asparagine, it has been surprisingly found that adding asparaginase to the homogenized tobacco material, and preferably the addition of asparaginase during the slurry formation as described according to the method of the invention, could decrease the amount of acrylamide present in the aerosol formed heating a portion of the homogenized tobacco material.

Preferably, said step of grinding tobacco of one or more tobacco type comprises blending one or more of the following tobaccos: bright tobacco; dark tobacco; aromatic tobacco; filler tobacco. Preferably, the homogenized tobacco material is formed by tobacco lamina and stem of different tobacco types, which are properly blended. With the term "tobacco type" one of the different varieties of tobacco is meant. With respect to the present invention, these different tobacco types are distinguished in three main groups of bright tobacco, dark tobacco and aromatic tobacco. The distinction between these three groups is based on the curing process the tobacco undergoes before it is further processed in a tobacco product.

Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos are tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland.

Additionally, a blend may comprise so called filler tobaccos. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cured Brazil lower stalk.

Within each type of tobaccos, the tobacco leaves are further graded for example with respect to origin, position in the plant, colour, surface texture, size and shape. These and other characteristics of the tobacco leaves are used to form a tobacco blend. A blend of tobacco is a mixture of tobaccos belonging to the same or different types such that the tobacco blend has an agglomerated specific characteristic. This characteristic can be for example a unique taste or a specific aerosol composition when heated or burned. A blend comprises specific tobacco types and grades in a given proportion one with respect to the other.

According to the invention, different grades within the same tobacco type may be cross-blended to reduce the variability of each blend component. Preferably, the different tobacco grades are selected in order to realize a desired blend having specific predetermined characteristics. For example, the blend may have a target value of the reducing sugars, total ammonia and total alkaloids per dry weight base of the homogenized tobacco material. Total alkaloids are for example nicotine and the minor alkaloids including nornicotine, anatabine, anabasine and myosmine.

For example, bright tobacco may comprise tobacco of grade A, tobacco of grade B and tobacco of grade C. Bright tobacco of grade A has slightly different chemical characteristics to bright tobacco of grade B and grade C. Aromatic tobacco may include tobacco of grade D and tobacco of grade E, where aromatic tobacco of grade D has slightly different chemical characteristics to aromatic tobacco of grade E. A possible target value for the tobacco blend, for the sake of exemplification, can be for example a content of reducing sugars of about 10 percent in dry weight basis of the total tobacco blend. In order to achieve the selected target value, a 70 percent bright tobacco and a 30 percent aromatic tobacco may be selected in order to form the tobacco blend. The 70 percent of the bright tobacco is selected among tobacco of grade A, tobacco of grade B and tobacco of grade C, while the 30 percent of aromatic tobacco is selected among tobacco of grade D and tobacco of grade E. The amounts of tobaccos of grade A, B, C, D, E which are included in the blend depend on the chemical composition of each of the tobaccos of grades A, B, C, D, E so as to meet the target value for the tobacco blend.

It has been found that the taste given by the blend of the selected tobaccos is typically not changed by the addition of the enzyme asparaginase in the slurry.

Preferably, the slurry has a temperature comprised between about 20 degrees Celsius and about 60 degrees Celsius while asparaginase is added. It has been observed that typically to obtain a slurry with a good tensile strength and relatively few defects, also the temperature of the slurry, which in turn is connected to the viscosity of the slurry, is a relevant parameter. A suitable range of temperatures for the slurry may be from about 20 degrees Celsius and 60 degrees Celsius. It has been shown that this is typically also an optimal range for the enzymatic activity of the asparaginase from the moment in which the asparaginase is introduced in the slurry.

Advantageously, the slurry is maintained at a temperature comprised between about 20 degrees Celsius and about 60 degrees Celsius for a time interval comprised between about 2 minutes and about 60 minutes, for example between about 5 minutes and about 30 minutes, between the addition of the asparaginase and the formation of the homogenized tobacco material. The necessary time of activity of the enzyme to reduce the amount of asparagine to a very low level, that is, to a level below about 95 percent of its initial content, may be rather quick. Preferably, during this time interval or for a portion of said time interval, the slurry is mixed, so that the enzyme is distributed within the whole volume of the slurry and the enzyme may convert the asparagine in aspartic acid catalyzing the hydrolysis of the former into the latter in the whole slurry volume. More preferably, the slurry, generally contained in a tank, is covered so that water is not evaporated, or it is evaporated only in a relatively limited quantity, while the enzymatic activity takes place, which generally requires heating. Preferably, the amount of humidity of the slurry is maintained within a preferred predetermined range. Preferably, the slurry includes, before casting, between about 60 percent and about 80 percent of water.

Preferably, said slurry has a pH comprised between about 5 and about 7, while the asparaginase is added. More preferably, a pH of said slurry is within this range during the enzymatic activity of said asparaginase. The reaction of asparaginase may depend, among others, on the pH of the slurry. A pH modifier may be added to the slurry to modify the pH. For example, a pH modifier may include NaOH to raise the pH level of the slurry. Other pH modifiers known in the art may be used as well.

Advantageously, the method comprises the step of adding an aerosol-former to the slurry. Suitable aerosol-formers for inclusion in slurry for homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. For example, where the homogenized tobacco material according to the specification is intended for use as aerosol-forming substrates in heated aerosol-generating articles, the homogenised tobacco material may have an aerosol-former content of between about 5 percent and about 30 percent by weight on a dry weight basis. Homogenized tobacco material intended for use in electrically-operated aerosol-generating system having a heating element may preferably include an aerosol former of between about 5 percent to about 30 percent of dry weight of the homogenized tobacco material, preferably between about 10 percent to about 25 percent of dry weight of the homogenized tobacco material. For homogenized tobacco material intended for use in electrically-operated aerosol-generating system having a heating element, the aerosol former may preferably be glycerol. Such an amount of aerosol-former is considered to be rather "high" compared to the amount of aerosol former present in known homogenized tobacco material. Preferably this high amount of aerosol—former is used to make a suspension with the binder present in the slurry so that substantially all binder is surrounded by aerosol-former molecules, in order to keep the binder away from water as much as possible when combined in the slurry. Binder and water may form a gel.

Asparaginase may have its activity reduced by the presence of an aerosol former, such as for example glycerol. Asparaginase may be stored in a buffered solution containing glycerol. It is typically recommended to dialyze out the glycerol or to dilute it, before usage, to ensure proper enzymatic activity. It has been surprisingly found that even with a "high" amount of aerosol—former present in the slurry, the homogenized tobacco material of the invention could still provide the benefit of the invention.

Preferably, the step of forming a homogenized tobacco material from the slurry comprises the steps of casting a web of the slurry, and drying the cast web.

A web of homogenized tobacco material is preferably formed by a casting process of the type generally comprising casting a slurry prepared as above described on a support surface. Preferably, the cast web is then dried to form a web of homogenized tobacco material and it is then removed from the support surface.

Preferably, the moisture of said homogenized tobacco material web at casting is between about 60 percent and about 80 percent of the total weight of the homogenized tobacco material web at casting. Preferably, the method for production of a homogenized tobacco material comprises the step of drying said homogenized tobacco material, winding said homogenized tobacco material. Preferably, the moisture of homogenized tobacco material web after winding is between about 7 percent and about 15 percent of dry weight of the homogenized tobacco material web. Preferably, the moisture of said homogenized tobacco material web at winding is between about 8 percent and about 12 percent of dry weight of the homogenized tobacco material web.

According to a third aspect, the invention relates to a homogenized tobacco material comprising cellulose fibres and water, a blend of particles of different tobacco types, and a binder, combined together to form a slurry. According to the invention, the tobacco particles have a mean particle size per weight between about 0.03 millimetres and about 0.12 millimetres, the amount of binder is comprised between about 1 percent and about 5 percent in dry weight of the slurry and the cellulose fibres are in an amount between about 1 percent and about 7 percent in dry weight of the slurry and their mean length per weight is comprised between about 0.2 millimetres and about 4 millimetres. The homogenized tobacco material further comprises asparaginase.

According to a fourth aspect, the invention relates to a homogenized tobacco material comprising cellulose fibres and water, a blend of particles of different tobacco types, and a binder, combined together to form a slurry. According to the invention, the tobacco particles have a mean particle size per weight between about 0.03 millimetres and about 0.12 millimetres and are included in an amount comprised between about 50 percent and about 93 percent in dry weight basis, and the cellulose fibres are in an amount between about 1 percent and about 7 percent in dry weight of the slurry and their mean length per weight is comprised between about 0.2 millimetres and about 4 millimetres. The homogenized tobacco material further comprises asparaginase.

Preferably, the percentage of cellulose fibres having a mean length per weight comprised between about 1 millimetres and 3 millimetres is equal to 4 times the standard deviation of the size of the cellulose fibres in said pulp. Fibres may be natural products having a very wide range of lengths before processing. Preferably, a narrower range than the natural one is obtained by a refining step. Due to the refining step of the method of the invention, the resulting fibres' lengths tend to be very close to the mean. This means that the variations in the lengths of the cellulose fibres are relatively small. The risk of inhomogeneity or defects in the homogenized tobacco material caused by fibres that are much longer than the mean value may be minimized. In particular, long fibres may create so called draggers in the cast tobacco web that frequently create extended inhomogeneous areas in the tobacco web. Preferably, the cellulose fibres are wood cellulose fibres. Alternatively, the source of the cellulose fibres is another plant material such as for example, tobacco, flax or hemp. The advantageous effects of asparaginase have been already described in the first aspect. Related advantages have already been explained in connection with the inventive method above and, for the sake of simplicity, will not be repeated.

Preferably, the homogenized tobacco material, after casting, is a substantially solid sheet of material. This sheet is then further cut and optionally wound in one or more bobbins. The dimensions of the sheet, such as thickness, depend on the final product to be obtained.

The homogenized tobacco material of the invention, either according to the third or the fourth aspect, includes the following ingredients:

Tobacco powder;
Binder;
Asparaginase; and
Cellulose fibres.
Optionally, it also includes an aerosol former.

Advantageously, one or more of the ingredients above listed are included in the following weight ratios in the homogenized tobacco material of the invention:

The binder and the cellulose fibres are preferably included in a weight ratio comprised between about 1:7 and about 5:1. More preferably, the binder and the cellulose fibres are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The binder and the asparaginase are preferably included in a weight ratio comprised between about 50:1 and about 4000:1.

The aerosol former and the tobacco particles are preferably included in a weight ratio comprised between about 1:20 and about 1:1. More preferably, the aerosol former and the tobacco particles are included in a weight ratio comprised between about 1:6 and about 1:2.

The aerosol former and the cellulose fibres are preferably included in a weight ratio comprised between about 1:1 and about 30:1. More preferably, the aerosol former and the cellulose fibres are included in a weight ratio comprised between about 5:1 and about 15:1.

The aerosol former and the asparaginase are preferably included in a weight ratio comprised between 250:1 and 25000:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The cellulose fibres and the asparaginase are preferably included in a weight ratio comprised between about 50:1 and about 6000:1.

The above mentioned weight ratios of the ingredients of the homogenized tobacco materials are applicable not only to the homogenized tobacco material, but also they are the weight ratios of the various ingredients present in the slurry.

A web of homogenized tobacco material is preferably formed by a casting process of the type generally comprising casting a tobacco slurry onto a moving metal belt. Preferably, the cast web is dried to form a web of homogenized tobacco material and it is then removed from the support surface.

Advantageously, said asparaginase is comprised between about 0.0012 percent and about 0.02 percent per weight on dry weight basis of said homogenized tobacco material. More preferably, the amount of asparaginase is comprised between about 500 active unit and 21000 active unit per kilogram of tobacco particles included in the homogenized tobacco material. The amount of asparaginase to be added preferably depends on the amount of asparagine, which in turn depends on the amount of tobacco present in the homogenized tobacco material. The amount of asparaginase is also selected to minimize possible side effects of the asparaginase itself and costs.

Advantageously, the asparaginase is added to the slurry not as a pure enzyme, but as a mixture of asparaginase and other ingredients.

Due to the addition of the asparaginase, the homogenized tobacco material comprises aspartic acid, due to the reaction between asparaginase and asparagine. The presence of aspartic acid confirms the enzymatic reaction.

The advantages of the invention according to the third and fourth aspects have been already discussed with reference to the first and second aspect and thus not herewith repeated.

According to a fifth aspect, the invention relates to an aerosol-generating article, comprising a component prepared from the homogenised tobacco material described above or prepared according to the method of the invention.

An aerosol-generating device is an article comprising an aerosol-forming substrate that is capable of releasing volatile compounds that can form an aerosol. An aerosol-generating article may be a non-combustible aerosol-generating article or may be a combustible aerosol-generating article. Preferably, the aerosol-generating article is a non-combustible aerosol-generating article. Non-combustible aerosol-generating article releases volatile compounds without the combustion of the aerosol-forming substrate, for example by heating the aerosol-forming substrate, or by a chemical reaction, or by mechanical stimulus of an aerosol-forming substrate. Combustible aerosol-generating article releases an aerosol by direct combustion of an aerosol-forming substrate, for example as in a conventional cigarette.

The aerosol-forming substrate is capable of releasing volatile compounds that can form an aerosol volatile compound and may be released by heating or combusting the aerosol-forming substrate. In order for the homogenized tobacco material to be used in an aerosol-forming generating article, aerosol formers are preferably included in the slurry that forms the cast leaf. The aerosol formers may be chosen based on one or more of predetermined characteristics. Functionally, the aerosol former provides a mechanism that allows the aerosol former to be volatilize and convey nicotine and/or flavouring in an aerosol when heated above the specific volatilization temperature of the aerosol former.

The presence of asparaginase, which reduces the content of asparagine in the homogenized tobacco material, reduces the amount of acrylamide in the aerosol obtained heating the homogenized tobacco material. Such reduction may be of more than about 70 percent with respect to a homogenized tobacco material realized according to the present disclosure without the addition of asparaginase.

The invention will be further described, by way of example only, with reference to the accompanying drawings in which.

Figure 1:
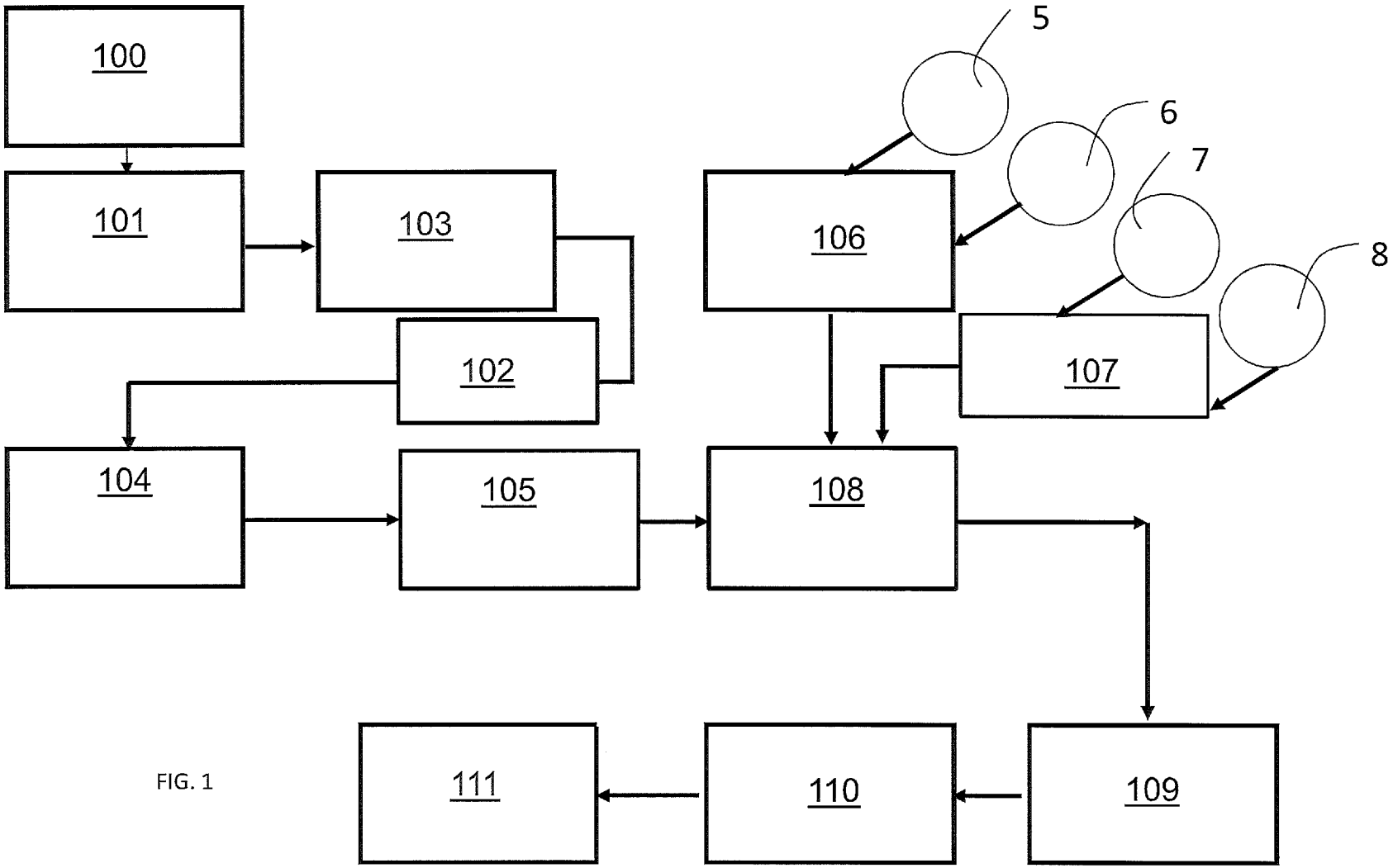
FIG. 1 shows a flow diagram of a method to produce an homogenized tobacco material according to the invention.

With initial reference to FIG. 1, a method for the production of slurry according to the present invention is represented. The first step of the method of the invention is the selection 100 of the tobacco types and tobacco grades to be used in the tobacco blend for producing the homogenized tobacco material. Tobacco types and tobacco grades used in the present method are for example bright tobacco, dark tobacco, aromatic tobacco and filler tobacco.

Only the selected tobacco types and tobacco grades intended to be production of the used for the homogenized tobacco material undergo the processing according to following steps of the method of the invention.

The method includes a further step 101 in which the selected tobacco is laid down. This step may comprise checking the tobacco integrity, such as grade and quantity, which can be for example verified by a bar code reader for product tracking and traceability. After harvesting and curing, the leaf of tobacco is given a grade, which describes for example the stalk position, quality, and colour.

Further, the lay down step 101 might also include, in case the tobacco is shipped to the manufacturing premises for the production of the homogenized tobacco material, de-boxing or case opening of the tobacco boxes. The de-boxed tobacco is then preferably fed to a weighing station in order to weight the same.

Moreover, the tobacco lay down step 101 may include bale slicing, if needed, as the tobacco leaves are normally compressed into bales in shipping boxes for shipping.

The following steps are performed for each tobacco type, as detailed below. These steps may be performed subsequently per grade such that only one production line is required. Alternatively, the different tobacco types may be processed in separate lines. This may be advantageous where the processing steps for some of the tobacco types are different. For example, in conventional primary tobacco processes bright tobaccos and dark tobaccos are processed at least partially in separate processes, as the dark tobacco often receives an additional casing. However, according to the present invention, preferably, no casing is added to the blended tobacco powder before formation of the homogenized tobacco web.

Further, the method of the invention includes a step 102 of coarse grinding of the tobacco leaves.

According to a variant of the method of the invention, after the tobacco lay down step 101 and before the tobacco coarse grinding step 102, a further shredding step 103 is performed, as depicted in FIG. 1. In the shredding step 103 the tobacco is shredded into strips having a mean size comprised between about 2 millimetres and about 100 millimetres.

Preferably, after the shredding step 103, a step of removal of non-tobacco material from the strips is performed (not depicted in FIG. 1).

Subsequently, the shredded tobacco is transported towards the coarse grinding step 102. The flow rate of tobacco into a mill to coarse grind the strips of tobacco leaf is preferably controlled and measured.

In the coarse grinding step 102, the tobacco strips are reduced to a mean particle size of between about 0.25 millimetres and about 2 millimetres. At this stage, the tobacco particles are still with their cells substantially intact and the resulting particles do not pose relevant transport issues.

Preferably, after the coarse grinding step 102, the tobacco particles are transported, for example by pneumatic transfer, to a blending step 104. Alternatively, the step of blending 104 could be performed before the step of coarse grinding 102, or where present, before the step of shredding 103, or, alternatively, between the step of shredding 103 and the step of coarse grinding 102.

In the blending step 104, all the coarse grinded tobacco particles of the different tobacco types selected for the tobacco blend are blended. The blending step 104 therefore is a single step for all the selected tobacco types. This means that after the step of blending there is only need for a single process line for all of the different tobacco types.

In the blending step 104, preferably mixing of the various tobacco types in particles is performed. Preferably a step of measuring and controlling one or more of the properties of the tobacco blend is performed. According to the invention, the flow of tobacco may be controlled such that the desired blend is obtained. For example, with reference to FIG. 2, it may be desirable that the blend includes bright tobacco 1 at least for about 30 percent in dry weight of the total tobacco in the blend, and that dark tobacco 2 and aromatic tobacco 3 are comprised each in a percentage between about 0 percent and about 40 percent in dry weight of the total tobacco in the blend, for example about 35 percent. More preferably, also filler tobacco 4 is introduced in a percentage between about 0 percent and about 20 percent in dry weight of the total tobacco in the blend. The flow rate of the different tobacco types is therefore controlled so that these ratios of the various tobacco types is obtained. Alternatively, where the coarse grinding step 102 is done subsequently for the different tobacco leafs used, the weighing step at the beginning of the step 102 determines the amount of tobacco used per tobacco type and grade instead of controlling its flow rate.

Figure 2:
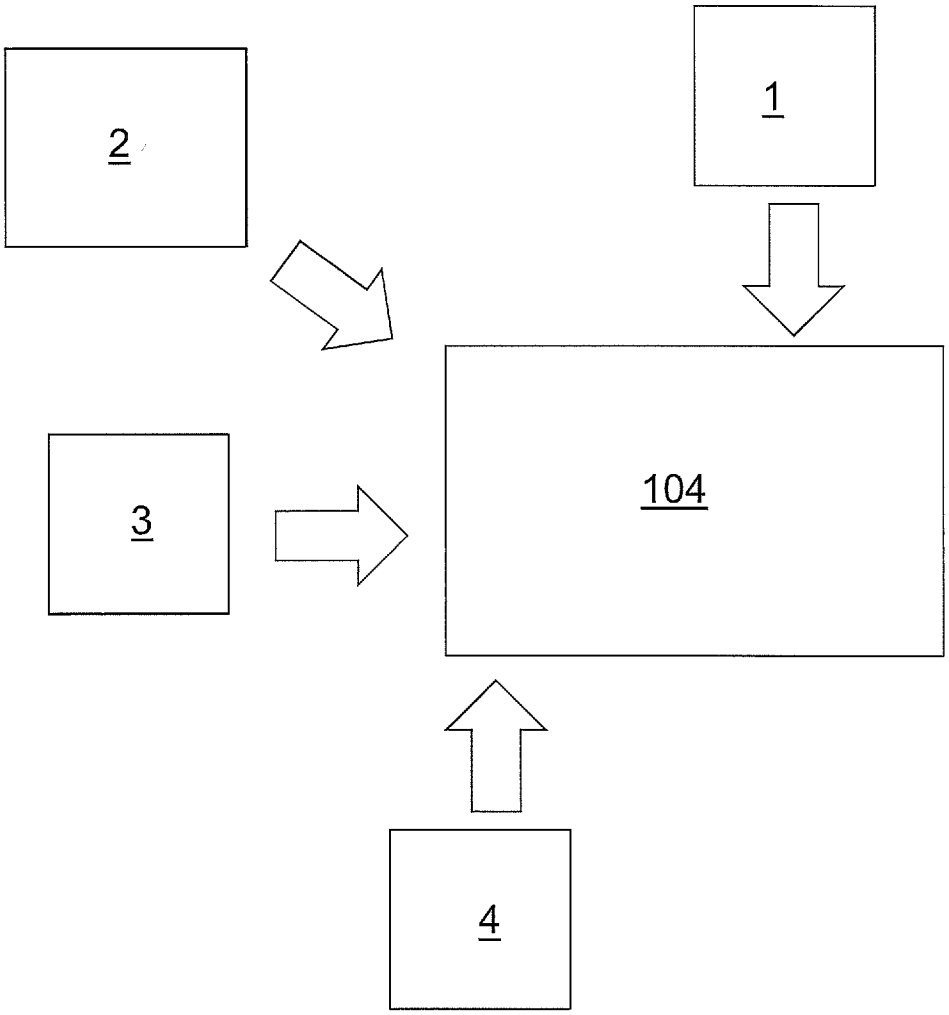
FIG. 2 shows an enlarged view of one of the step of the method of FIG. 1.

In FIG. 2, the introduction of the various tobacco types during the blending step 104 is shown.

It is to be understood that each tobacco type could be itself a sub-blend, in other words, the "bright tobacco type" could be for example a blend of Virginia tobacco and Brazil flue-cured tobacco of different grades.

After the blending step 104, a fine grinding step 105, to a tobacco powder mean size of between about 0.03 millimetres and about 0.12 millimetres is performed. This fine grinding step 105 reduces the size of the tobacco down to a powder size suitable for the slurry preparation. After this fine grinding step 105, the cells of the tobacco are at least partially destroyed and the tobacco powder may become sticky.

The so obtained tobacco powder can be immediately used to form the tobacco slurry. Alternatively, a further step of storage of the tobacco powder, for example in suitable containers may be inserted (not shown).

Figure 3:
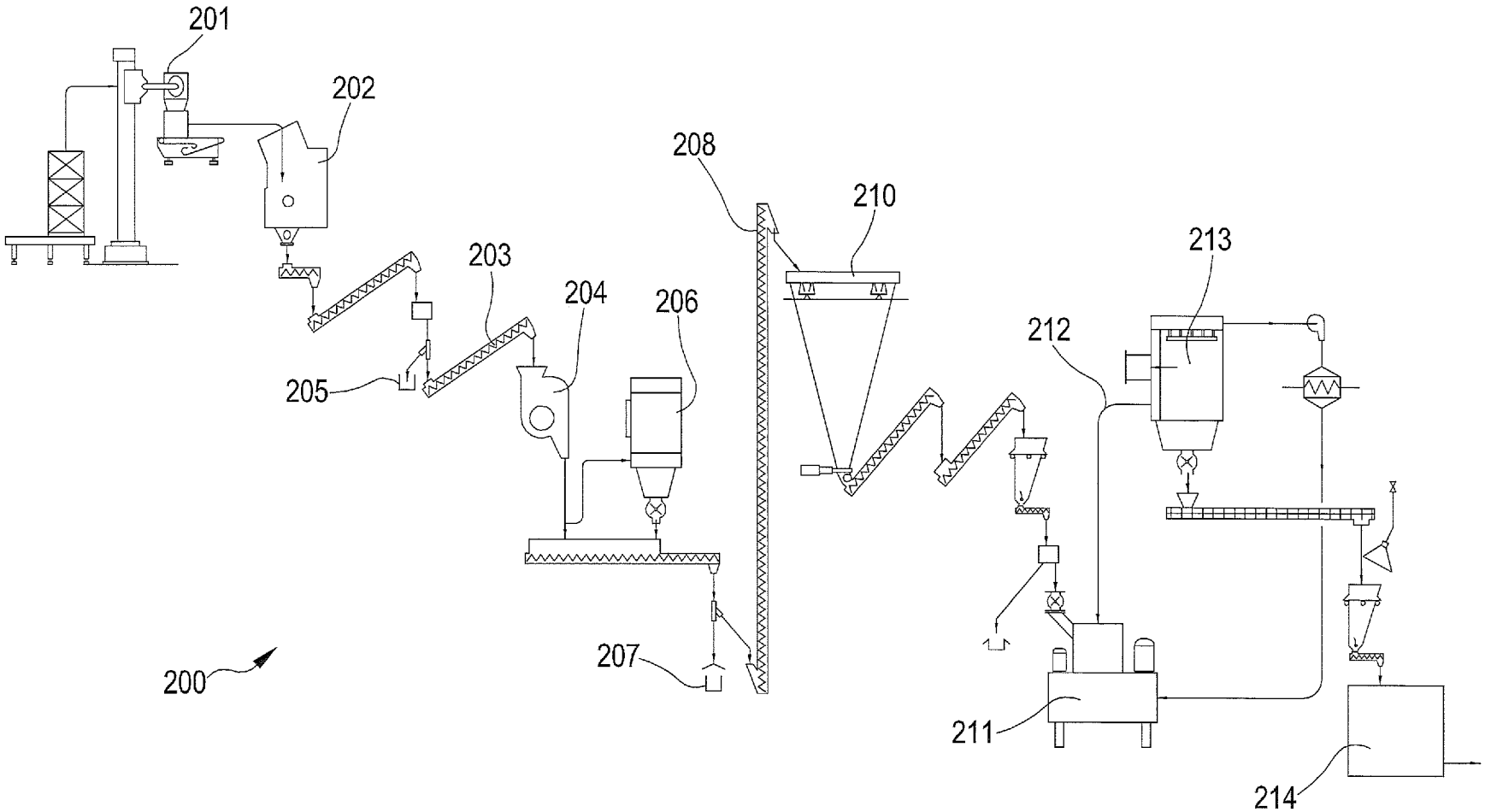
FIG. 3 shows a schematic view of an apparatus for performing a step of the method of FIG. 1.

The steps of tobacco blending 104 and grinding tobacco 102, 105 for the formation of a homogenized tobacco material according to FIG. 1 are performed using an apparatus for the grinding and blending of tobacco 200 depicted schematically in FIG. 3. The apparatus 200 includes a tobacco receiving station 201, where accumulating, destacking, weighing and inspecting the different tobacco types takes place. Optionally, in case the tobacco has been shipped into cartons, in the receiving station 201 removal of cartons containing the tobacco is performed. The tobacco receiving station 201 also optionally comprises a tobacco bale splitting unit.

In FIG. 3 only a production line for one type of tobacco is shown, but the same equipment may be present for each tobacco type used in the homogenised tobacco material web according to the invention, depending on when the step of blending is performed. Further the tobacco is introduced in a shredder 202 for the shredding step 103. Shredder 202 can be for example a pin shredder. The shredder 202 is preferably adapted to handle all sizes of bales, to loosen tobacco strips and shred strips into smaller pieces. The shreds of tobacco in each production line are transported, for example by means of pneumatic transport 203, to a mill 204 for the coarse grinding step 102. Preferably, a control is made during the transport so as to reject foreign material in the tobacco shreds. For example, along the pneumatic transport of shredded tobacco, a string removal conveyor system, heavy particle separator and metal detector may be present, all indicated with 205 in the appended drawing.

Mill 204 is adapted to coarse grind the tobacco strips up to a size of between about 0.25 millimetres and about 2 millimetres. The rotor speed of the mill can be controlled and changed on the basis of the tobacco shreds flow rate.

Preferably, a buffer silo 206 for uniform mass flow control, is located after the coarse grinder mill 204. Furthermore, preferably mill 204 is equipped with spark detectors and safety shut down system 207 for safety reasons.

From the mill 204, the tobacco particles are transported, for example by means of a pneumatic transport 208, to a blender 210. Blender 210 preferably includes a silo in which an appropriate valve control system is present. In the blender, all tobacco particles of all the different types of tobacco which have been selected for the predetermined blend are introduced. In the blender 210, the tobacco particles are mixed to a uniform blend. From the blender 210, the blend of tobacco particles is transported to a fine grinding station 211.

Fine grinding station 211 is for example an impact classifying mill with suitable designed ancillary equipment to produce fine tobacco powder to the right specifications, that is, to a tobacco powder between about 0.03 millimetres and about 0.12 millimetres. After the fine grinding station 211, a pneumatic transfer line 212 is adapted to transporting the fine tobacco powder to a buffer powder silo 213 for continuous feed to a downstream slurry batch mixing tank where the slurry preparation process takes place.

The method for the production of a homogenized tobacco material of FIG. 1 further includes a step of suspension preparation 106. The suspension preparation step 106 preferably comprises mixing an aerosol-former 5 and a binder 6 in order to form a suspension. Preferably, the aerosol—former 5 comprises glycerol and the binder 6 comprises guar.

The step of forming a suspension 106 of binder in aerosol-former includes the steps of loading the aerosol-former 5 and the binder 6 in a container and mixing the two. Preferably, the resulting suspension is then stored before being introduced in the slurry. Preferably, the glycerol is added to the guar in two steps, a first amount of glycerol is mixed with guar and a second amount of glycerol is then injected in the transport pipes, so that glycerol is used to clean the processing line, avoiding hard-to-clean points within the line.

Figure 4:
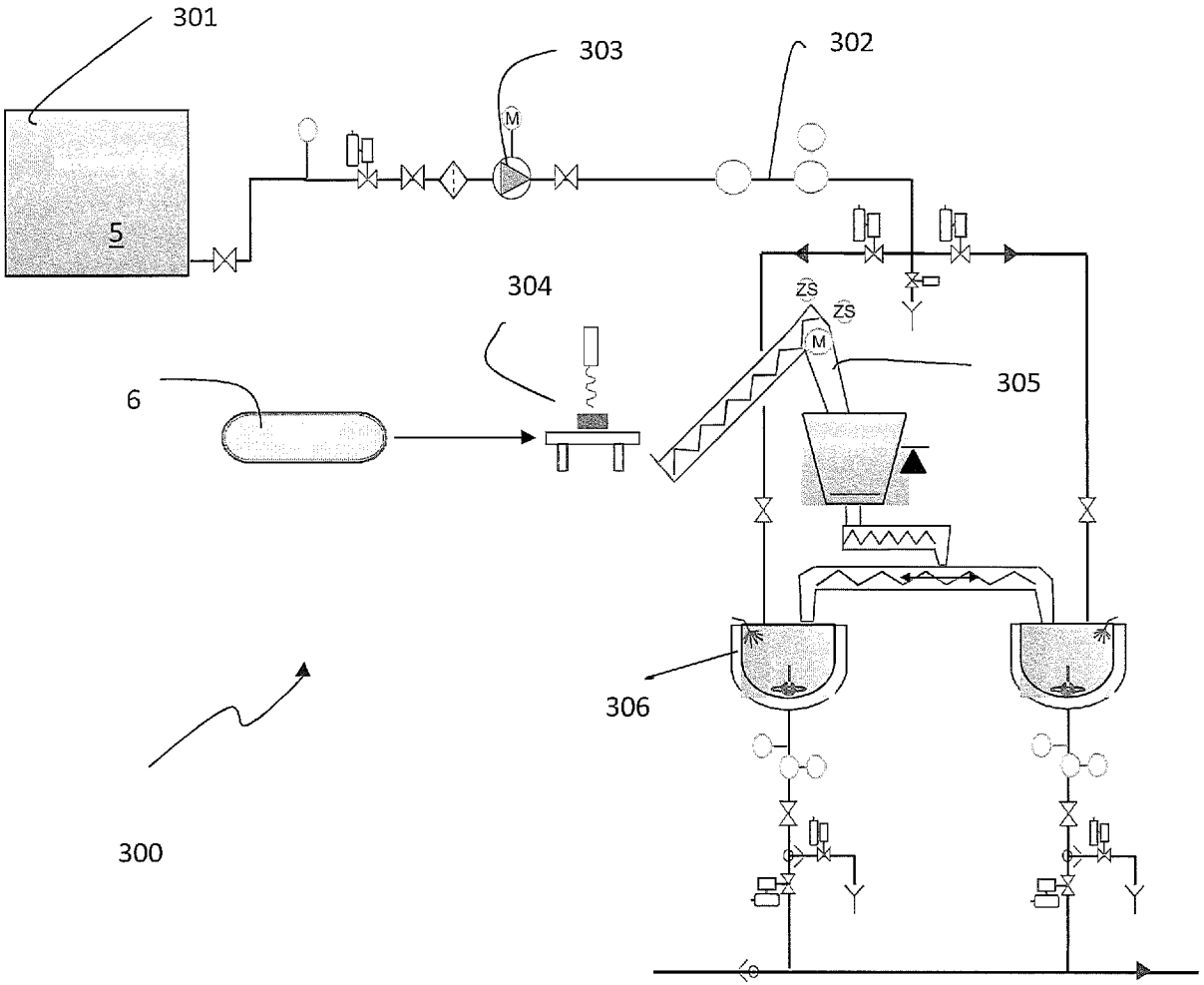
FIG. 4 shows a schematic view of an apparatus for performing another step of the method of FIG. 1.

A slurry preparation line 300 adapted to perform the suspension of binder in aerosol-former as per step 106 of the invention is depicted in FIG. 4.

The slurry preparation line 300 includes an aerosol-former, such as glycerol, bulk tank 301 and a pipe transfer system 302 having a mass flow control system 303 adapted to transfer the aerosol-former 5 from the tank 301 and to control its flow rate. Further, the slurry preparation line 300 comprises a binder handling station 304 and a pneumatic transport and dosing system 305 to transport and weight the binder 6 received at the station 304.

Aerosol-former 5 and binder 6 from tank 301 and handling station 304, respectively, are transported to a mixing tank, or more than a mixing tank, 306, part of the slurry preparation line 300, designed to mix binder 6 and aerosol-former 5 uniformly.

The method to realize the homogenized tobacco material includes a step of preparing a cellulose pulp 107. The pulp preparation step 107 preferably comprises mixing cellulose fibres 7 and water 8 in a concentrated form, optionally storing the pulp so obtained and then diluting the concentrated pulp before forming the slurry. The cellulose fibres, for example in boards or bags, are loaded in a pulper and then liquefied with water. The resulting water—cellulose solution may be stored at different densities, however preferably the pulp which is the result of the step 107 is "concentrate". Preferably, "concentrate" means that the total amount in the cellulose fibres in the pulp is between about 3 percent and 5 percent of the total pulp weight before dilution. Preferred cellulose fibres are soft wood fibres. Preferably, the total amount of cellulose fibres in the slurry in dry weight is between about 1 percent and about 7 percent, preferably, between about 1.2 percent and about 2.4 percent in dry weight of the slurry.

Preferably, the step of mixing of water and cellulose fibres lasts between about 20 and about 60 minutes, advantageously at a temperature comprised between about 15 degrees Celsius and about 40 degrees Celsius.

The storage time, if storage of the pulp is performed, may preferably vary between about 0.1 day and about 7 days.

Advantageously, water dilution takes place after the step of storing of the concentrated pulp. Water is added to the concentrated pulp in such an amount that the cellulose fibres are less than about 1 percent of the total weight of the pulp. For example a dilution of a factor comprised between about 3 and about 20 can take place. Further, an additional step of mixing may take place, which comprises mixing the concentrated pulp and the added water. The additional mixing step preferably lasts between about 120 minutes and about 180 minutes at a temperature between about 15 degrees Celsius and about 40 degrees Celsius, more preferably at a temperature of between about 18 degrees Celsius and about 25 degrees Celsius.

All tanks and transfer pipes for cellulose fiber, guar and glycerol are preferably designed to be as optimally short as possible to reduce transfer time, minimize waste, avoid cross contamination and facilitate ease of cleaning. Further, preferably, the transfer pipes for cellulose fiber, guar and glycerol are as straight as possible, to allow a swift and uninterrupted flow. In particular for the suspension of binder in the aerosol-former, turns in the transfer pipe could otherwise result in areas of low flow rate or even standstill, which in turn can be areas where gelling can occur and with that potentially blockages within the transfer pipes. As mentioned before, those blockages can lead to the need for cleaning and standstill of the entire manufacturing process.

Preferably, after the step of pulp preparation 107, an optional step of fibres' fibrillation is performed (not depicted in FIG. 1).

Figure 5:
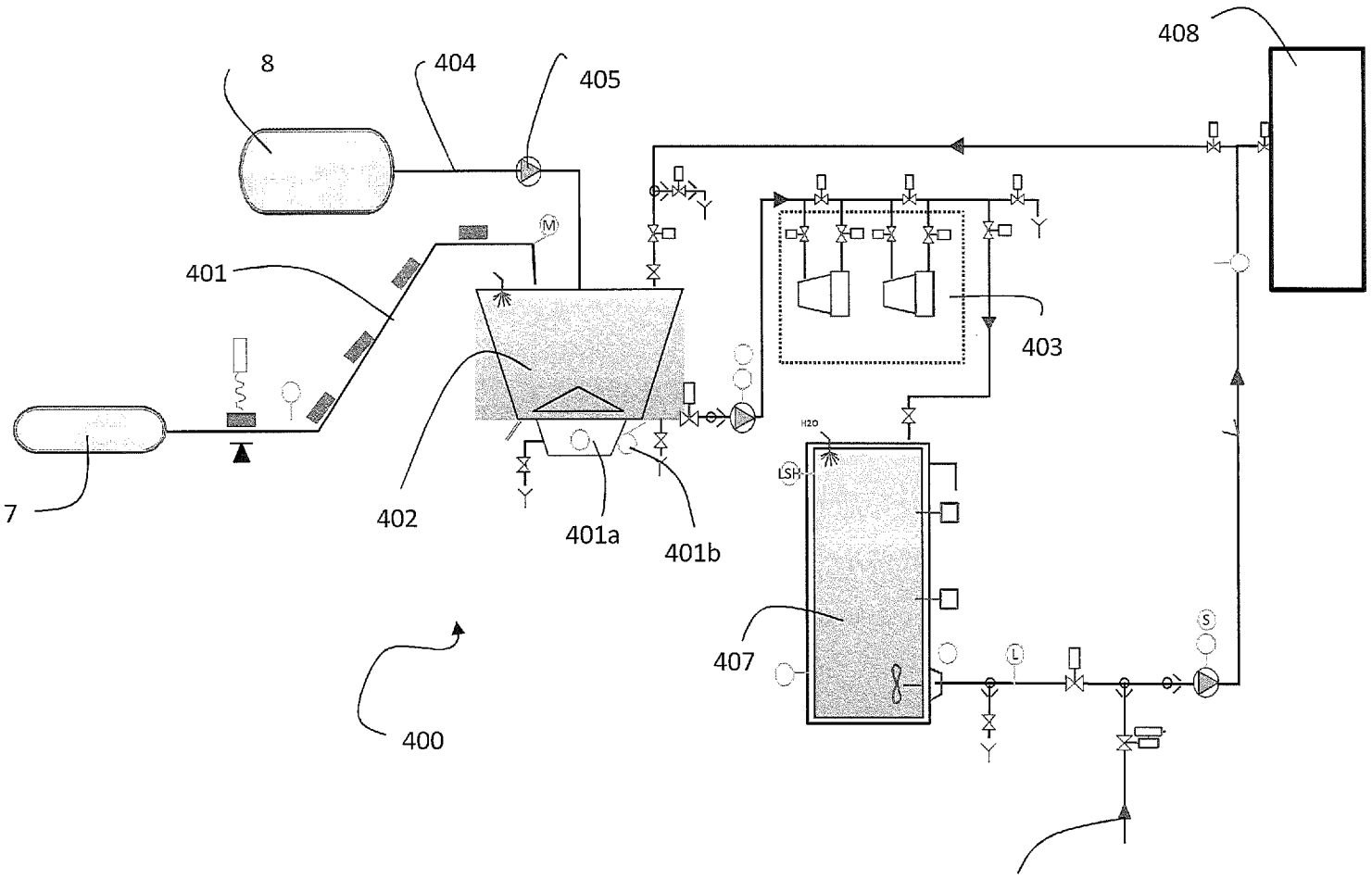
FIG. 5 shows a schematic view of an apparatus for performing a further step of the method of FIG. 1.

An apparatus 400 to perform the method step 107 of the pulp formation is depicted in FIG. 5. FIG. 5 schematically depicts a cellulose fibre feeding and preparation line 400 comprising a feeding system 401, preferably adapted to handle cellulose fibres 7 in bulk form, such as board/sheets or fluffed fibres, and a pulper 402. The feeding system 401 is adapted to direct the cellulose fibres to the pulper 402, which is in turn adapted to disperse the received fibres uniformly.

The pulper 402 includes a temperature control unit 401*a* so that the temperature in the pulper is kept within a given temperature interval, and a rotational speed control unit 401*b*, so that the speed of an impeller (not shown) present in the pulper 402 is controlled and kept preferably comprised between about 5 rpm and about 35 rpm.

The cellulose fibre feeding and preparation line 400 further comprises a water line 404 adapted to introduce water 8 in the pulper 402. A flow rate controller 405 to control the flow rate of water introduced in pulper 402 is preferably added in the water line 404.

The cellulose fibre feeding and preparation line 400 may also further comprise a fibre refiner system 403 to treat and fibrillate fibres, so that long fibres and nested fibres are removed, and a uniform fibre distribution is obtained.

Preferably, the mean size of the cellulose fibres at the end of the pulping and refining step is comprised between about 0.2 millimetres and about 4 millimetres, more preferably between about 1 millimetre and about 3 millimetres.

Downstream the fibre refiner system 403, the cellulose fibre feeding and preparation line 400 may comprise a cellulose buffer tank 407 connected to the fibre refiner system 403 to store the high consistency fibre solution coming out of the system 403.

At the end of cellulose fibre feeding and preparation line 400, a cellulose dilution tank 408 in which pulp is diluted is preferably present and connected to cellulose buffer tank 407. The cellulose dilution tank 408 is adapted to batch out cellulose fibres of right consistency for subsequent slurry mixing. Water for dilution is introduced in tank 408 via a second water line 410.

Figure 6:
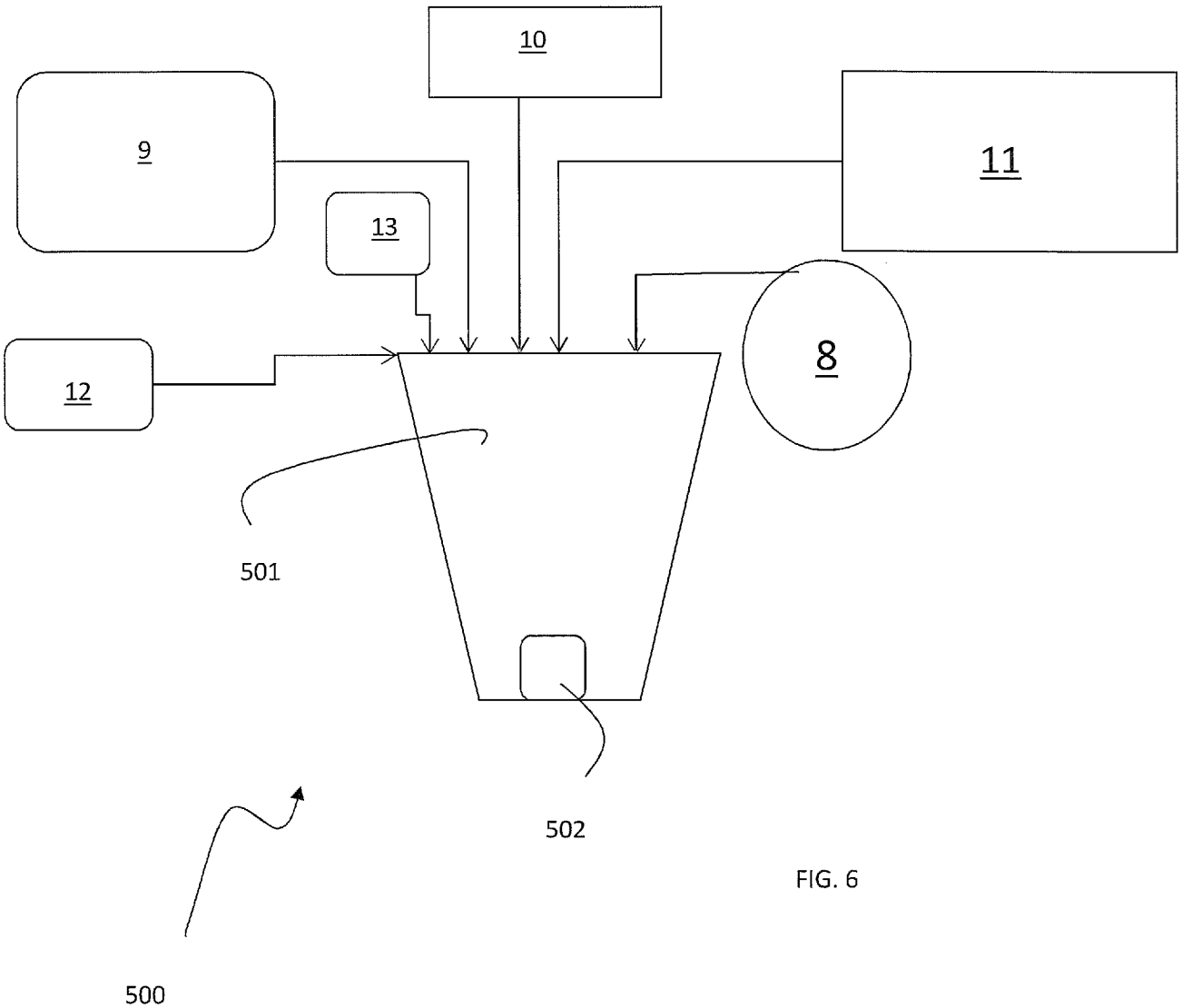
FIG. 6 shows a schematic view of an apparatus for performing a further step of the method of FIG. 1.

The method to form a slurry according to the invention further comprises a step of slurry formation 108, where the suspension 9 of binder in aerosol-former obtained in step 106, the pulp 10 obtained in step 107 and the tobacco powder blend 11 obtained in step 104 are combined together (see FIG. 6).

Further, in this step 108 an asparaginase mixture 12 containing asparaginase is introduced in the slurry. Optionally, a pH modifier 13 can be added as well before the step of asparaginase introduction.

Preferably, the step of slurry formation 108 comprises first a step of introduction in a tank of the suspension 9 of binder in aerosol-former and of the cellulose pulp 10. Afterwards, the tobacco powder blend 11 is introduced as well. Preferably, the suspension 9, the pulp 10 and the tobacco powder blend 11 are suitably dosed in order to control the amount of each of them introduced in the tank. The slurry is prepared according to specific proportion among its ingredients. Optionally, also water 8 is added as well.

Preferably, the step of slurry formation 108 also comprises a mixing step, where all the slurry ingredients are mixed together for a fixed amount of time. Preferably asparaginase mixture 12 and optionally pH modifier are added after a first mixing step and then mixing is continued in a second mixing step. More preferably, the pH modifier 13 is introduced in the water used to dilute the slurry and then added to the slurry itself.

In a preferred embodiment, the step of slurry formation 108 also includes a step of heating the slurry to a predetermined temperature, preferably comprised between about 20 degrees Celsius and about 60 degrees Celsius, before the step of adding the asparaginase mixture 12. After the desired temperature has been reached, then the step of adding the asparaginase mixture 12 takes place. After the asparaginase mixture has been added, preferably the selected temperature comprised between about 20 degrees Celsius and 60 degrees Celsius is kept for about between about 2 minutes and about 60 minutes. Advantageously, during this step of keeping the desired temperature, the second mixing step takes place and the slurry is continuously mixed. In this step where the slurry is mixed and the temperature is at the desired value, the enzymatic activity of the asparaginase comprised in the asparaginase mixture takes place.

In a preferred embodiment, the pH modifier 13 is also added before the asparaginase mixture 12 addition, so that the desired pH, for example a pH comprised between about 5 and about 7 is reached, so as to optimize enzymatic activity of the asparaginase included in the mixture 12. Preferably, the amount of asparaginase mixture added in the slurry is such that the amount of asparaginase per weight in dry weight basis of the slurry is comprised between about 0.0012 percent and about 0.02 percent.

Further, the step of slurry formation 108 may also include a subsequent cooling step, so that the slurry is cooled after the desired enzymatic activity has taken place, in order to block or minimize the latter. Preferably, the temperature reached by the slurry after this cooling step is of about between about 9 degrees Celsius and about 11 degrees Celsius. The cooling step takes place in case the slurry is stored before casting, as described below.

In a further step of the method according to the invention, the slurry is then transferred to a following casting step 109 and drying step 110.

An apparatus 500 for the slurry formation adapted to realize step 108 of the method of the invention is schematically depicted in FIG. 6. Apparatus 500 includes a mixing tank 501 where cellulose pulp 10 and suspension 9 of binder in aerosol-former are introduced. Further, the tobacco powder blend 11 from the blending and grinding line is fine-ground and dosed into the mixing tank 501 in specified quantity to prepare the slurry.

For example, the tobacco powder blend 11 may be contained in a tobacco fine powder buffer storage silo to ensure continuous upstream powder operation and meeting demand of slurry mixing process. Tobacco powder is transferred to the mixing tank 501 preferably by means of a pneumatic transfer system (not shown).

The apparatus 500 further comprises preferably a powder dosing/weighing system (also not shown) to dose required amount of the slurry's ingredients. For example, the tobacco powder may be weighted by a scale (not shown) or weighting belt (not shown) for precise dosing. The mixing tank 501 is specially designed to mix the dry and liquid ingredients to form a homogenous slurry. The slurry mixing tank preferably comprises a cooler (not shown), such as water jacket wall to allow water cooled on the external walls of the mixing tank 501. Further, it may also include heating means (also not visible) to change the temperature of the slurry in the mixing tank. The slurry mixing tank 501 is further equipped with one or more sensors (not shown) such as a level sensor, a temperature probe and a sampling port for control and monitoring purpose. Mixing tank 501 has an impeller 502 adapted to ensure uniform mixing of the slurry, in particular adapted to transfer slurry form the external walls of the tank to the internal part of the tank or vice-versa. The speed of the impeller can be preferably controlled by means of a dedicated controlling unit. Mixing tank 501 also includes a water line for the introduction of water 8 at a controlled flow rate. Preferably, in the water line 8 the pH modifier 13 is added before being poured into the tank 501. Asparaginase mixture 12 is added into the mixing tank as well.

Preferably, mixing tank 501 includes two separated tanks, one downstream to the other in the flow of slurry, one tank for preparing the slurry and the second tank with slurry for transfer to provide continuous slurry supply to a casting station.

The method of the invention to produce a homogenized tobacco web includes further a casting step 109 in which the slurry prepared in step 108 is cast in a continuous tobacco web onto a support. The casting step 109 includes transferring the slurry from the mixing tank 501 to a casting box. Further, it preferably includes monitoring the level of slurry in the casting box and the moisture of the slurry. Then, the casting step 109 includes casting, preferably by means of a casting blade, the slurry onto a support, such as a steel conveyor. Further, in order to obtain a final homogenized tobacco web for the use in an aerosol-formed article, the method of the invention includes a drying step 110 in which the cast web of homogenized tobacco material is preferably dried. The drying step 110 includes drying the cast web, by means of steam and heated air. Preferably the drying with steam is performed on the side of the cast web in contact with the support, while the drying with heated air is performed on the free side of the cast web.

Figure 7:
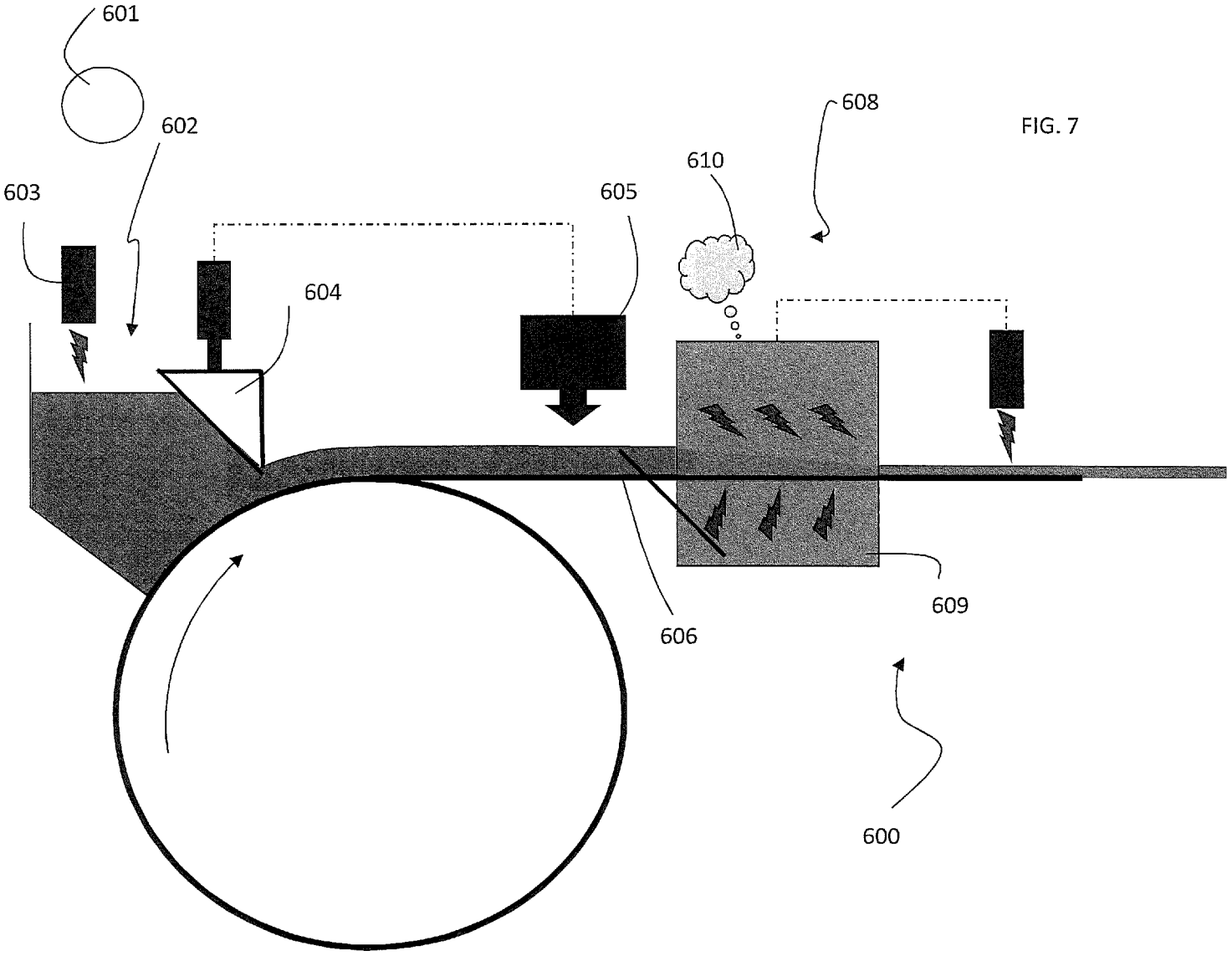
FIG. 7 shows a schematic view of an apparatus for performing a further step of the method of FIG. 1.

An apparatus 600 for performing the steps of casting 109 and drying 110 is schematically depicted in FIG. 7. The casting and drying apparatus 600 includes a slurry transfer system 601, such as a pump, preferably having a flow control, and a casting box 602 to which the slurry is transferred by the pump. Preferably, casting box 602 is equipped with level control 603 and a casting blade 604 for the casting of the slurry into a continuous web of homogenized tobacco material. Casting box 602 may also comprise a density control device 605 to control the density of the cast web.

A support, such as a stainless steel belt conveyor 606, receives the slurry cast by the casting blade 604.

Casting and drying apparatus 600 also includes a drying station 608 to dry the cast web of slurry. Drying station 608 comprises a steam heating 609 and top air drying 610.

Preferably, at the end of the casting step 109 and of the drying step 110, the homogenized tobacco web is removed from the support 606. Doctoring of the cast web after the drying station 608 at the right moisture content is preferably performed.

The cast web goes preferably through a secondary drying process to remove further moisture content of the web to reach moisture target or specification.

After the drying step 110, the cast web is preferably wound in one or more bobbins in a winding step 111, for example to form a single master bobbin. This master bobbin may be then used to perform the production of smaller bobbins by slitting and small bobbin forming process. The smaller bobbin may then be used for the production of an aerosol-generating article (not shown).

EXAMPLES

In the following examples, the asparaginase used may be Acrylaway® L produced by Novozymes U.K. Ltd.

1. Reference Control Examples

A reference aerosol—generating article is prepared using a cast and dried homogenized tobacco material realized according to the method above described of steps 101-111 but without the addition of the asparaginase mixture 12 into the slurry. This is used as reference control sample.

The slurry is prepared according to steps 101-108 without the addition of asparaginase mixture 12 and with the composition according to TABLE 1:

TABLE 1

| | | % DWB | Kg/100 kg batch |
|---|---|---|---|
| Tobacco | | 75% | 21 |
| Binder | Guar | 3% | 0.75 |
| | Fibers | 2% | 0.5 |
| Aerosol former | Glycerin | 20% | 5 |
| Water | | | 73 |

DWB = dry weight basis (referred to the total slurry)

Always using the slurry having the composition of TABLE 1, four different types of control samples have been prepared:

a) The pH of the slurry is maintained at about pH 5.2. The temperature of the slurry is maintained at about 28 degrees Celsius. The slurry is then cast according to steps 109-111 above described.
b) The pH of the slurry is maintained at about pH 5.2. The temperature of the slurry is raised at about 55 degrees Celsius and this temperature is maintained for about 60 minutes. The slurry is then cast according to steps 109-111 of the method of the invention.
c) The pH of the slurry is modified by means of a pH modifier (NaOH) and raised at about pH 6. The temperature of the slurry is maintained at about 55 degrees Celsius for about 60 minutes. The slurry is then cast according to steps 109-111 above described.
d) The pH of the slurry is modified by means of a pH modifier and raised at about pH 6.5. The temperature of the slurry is maintained at about 55 degrees Celsius for about 60 minutes. The slurry is then cast according to steps 109-111 above described.

2. Process Control Examples

The slurry preparation and composition is identical to the first control example, but to the slurry an inactive asparagine enzyme has been added. The enzyme is included in an asparaginase mixture which was inactivated by placing an amount of about 2-3 ml of asparaginase mixture in boiling water bath for five minutes. Two different samples have been prepared, which includes a slurry according to Table 1 with the addition of the inactive asparaginase mixture:

a) The pH of the slurry is modified by means of a pH modifier (NaOH) and raised to about pH 6. The temperature of the slurry is maintained at about 55 degrees Celsius for about 60 minutes. The slurry is then cast according to steps 109-111 above described.
b) The pH of the slurry is modified by means of a pH modifier (NaOH) and raised to about pH 6.5. The temperature of the slurry is maintained at about 55 degrees Celsius for about 60 minutes. The slurry is then cast according to steps 109-111 above described.

3. Homogenized Tobacco Material According to the Invention

A slurry according to steps 101-108 is formed according to the ingredients of TABLE 2:

TABLE 2

| | | % DWB | Kg/100 kg batch |
|---|---|---|---|
| Tobacco | | 75% | 21 |
| Binder | Guar | 3% | 0.75 |
| | Fibers | 2% | 0.5 |

TABLE 2-continued

| | | % DWB | Kg/100 kg batch |
|---|---|---|---|
| Aerosol former | Glycerin | 20% | 5 |
| Water | | | 73 |
| Asparaginase mixture | | 0.5% (4100 U/mL) | 0.125 |

In the slurry of the following examples of the invention, the asparaginase mixture comprises 4% of Asparaginase, which results in 0.0054 kg of Asparaginase.

The enzyme used has a declared activity of 3500 ASNU/g and a density of 1.17 g/ml.

Three different samples of homogenized tobacco materials have been prepared using the above asparaginase mixture:

a) The slurry is not heated (temperature maintained at about 30° C.) and the pH is not changed (no addition of NaOH and pH at about 5.3). More in detail: about 800 grams of slurry is prepared according to steps 101-108. Slurry is maintained at about 30 degrees Celsius in a water bath. pH is not modified. About 850 μl of Asparaginase mixture is added while stirring in an amount of about 0.5 percent in dry weight basis. After asparaginase has been added, slurry is maintained at 30 degrees Celsius for about 60 minutes with stirring. Slurry is placed in ice bath to stop reaction. Slurry is casted according to steps 109-111.

b) The asparaginase mixture in an amount of about 0.5 percent in dry weight basis is added to the slurry (total slurry 800 ml). Further a pH modifier is added as well, in this case an amount of about 10 percent of NaOH (12.4 g) to raise the pH of tobacco slurry from about 5.39 to about 6.00. The NaOH is added into the water used for slurry preparation. This also avoids tobacco coming into immediate contact with high concentration of NaOH before dispersion into slurry.

Slurry is heated to about 55 degrees Celsius on water bath while stirring the slurry. The slurry is covered while heating to minimise water loss. The slurry is left for about 10 minutes to reach the temperature of about 55 degrees Celsius, then about 850 μl asparaginase mixture is added while stirring. After the addition of asparaginase mixture, the slurry is maintained at about 55 degrees Celsius for specified time (about 10 min) with stirring. Slurry is placed in ice bath to stop reaction. pH of slurry is measured. Slurry is casted according to steps 109-111.

c) As in 3(b), but the slurry is maintained at about 55 degrees Celsius for 30 minutes after asparaginase addition.

d) As in 3(b), but the slurry is maintained at about 55 degrees Celsius for 60 minutes after asparaginase addition.

e) As in 3(d), but the amount of added NaOH is modified so that the pH of the slurry is changed to about 6.5.

All samples, both reference and process samples and the samples according to the invention are summarized in the Table 3:

TABLE 3

| Description | Name | pH_Target | Time (min) | Temperature ° C. |
|---|---|---|---|---|
| Reference | 1a | 5.3 | — | 28 |
| example without | 1b | 5.3 | 60 | 55 |
| Enzyme | 1c | 6 | 60 | 55 |
| | 1d | 6.5 | 60 | 55 |
| Process example | 2a | 6 | 60 | 55 |
| with Inactive Enzyme | 2d | 6.5 | 60 | 55 |
| Examples with | 3a | 5.3 | 60 | 30 |
| Active Enzyme | 3b | 6 | 10 | 55 |
| | 3c | 6 | 30 | 55 |
| | 3d | 6 | 60 | 55 |
| | 3e | 6.5 | 60 | 55 |

The "Name" is the name of the sample: sample 1*a* refers to the sample realized according to the example 1a (control sample). "pH target" identifies the target pH for the slurry. "Temperature" refers to the temperature reached in degrees Celsius before the addition of asparaginase mixture and maintained for "time" in minutes after the addition of asparaginase mixture.

The homogenized tobacco materials produced using the slurry realized according to the above examples in Table 3 have been analysed and the results in term of the amount of nicotine, glycerine, ammonia, reducing sugar (RS) and total alkaloids (TA) in dry weight basis (DWB) of the total weight of the homogenized tobacco material are listed in Table 4:

TABLE 4

| Description | Name | pH_Target | Time (min) | Temperature ° C. | Glycerin (DWB) % (w/w) | Nicotine (DWB) % (w/w) | TA (DWB) % (w/w) | RS (DWB) % (w/w) | $NH_3$ (DWB) % (w/w) |
|---|---|---|---|---|---|---|---|---|---|
| Tobacco power blend | | — | — | — | | | 2.62 | 10.35 | 0.12 |
| NO | 1a | 5.3 | — | 28 | 20.1 | 1.9 | 2.62 | 11.00 | 0.10 |
| Enzyme | 1b | 5.3 | 60 | 55 | 19.5 | 1.9 | 2.61 | 11.51 | 0.10 |
| | 1c | 6 | 60 | 55 | 20.0 | 1.9 | 2.53 | 11.42 | 0.09 |
| | 1d | 6.5 | 60 | 55 | 19.4 | 1.8 | 2.46 | 11.05 | 0.09 |
| Inactive | 2a | 6 | 60 | 55 | 20.3 | 1.8 | 2.49 | 11.31 | 0.09 |
| Enzyme | 2b | 6.5 | 60 | 55 | 19.9 | 1.8 | 2.44 | 10.91 | 0.09 |
| Active | 3a | 5.3 | 60 | 30 | 20.1 | 1.9 | 2.54 | 11.20 | 0.16 |
| Enzyme | 3b | 6 | 10 | 55 | 20.2 | 1.9 | 2.48 | 10.79 | 0.14 |
| | 3c | 6 | 30 | 55 | 19.9 | 1.8 | 2.38 | 10.88 | 0.12 |
| | 3d | 6 | 60 | 55 | 20.2 | 1.9 | 2.55 | 11.17 | 0.15 |
| | 3e | 6.5 | 60 | 55 | 20.2 | 1.8 | 2.51 | 11.05 | 0.14 |

The above Table 4 shows that the amounts of Nicotine, Reducing Sugars and Total Alkaloids (in dry weight basis, DWB) in the homogenized tobacco materials are substantially the same (no substantial variations, or variations below 10 percent) in the control samples without enzyme or with inactive enzyme and with active enzyme, and they do not vary with the addition of asparaginase. On the other hand, ammonia increases when asparaginase in an active form is added in the slurry, as per the examples 3 (a, b, c, d, e) described above. The ammonia does not increase when asparaginase is introduced in the inactive form.

The amount of ammonia increases due to the enzymatic transformation of L-asparagine+$H_2O$→L-aspartate+$NH_3$. Some ammonia is always present in tobacco regardless of the presence of asparaginase. The increase due to asparaginase addition is comprised between about 36 percent and about 51 percent.

According to the reaction, it can be written that:

Asparagine (Mol.wt=132.1 g/mole)=Aspartic acid (Mol.wt=133.11 g/mole)+$NH_3$ (17.03 g/mole)

1 mg Asparagine transformed=1.01 mg Aspartic acid+0.13 mg $NH_3$

The amount of Aspartic acid (mg) and Ammonia (mg) formed in all samples where active Asparaginase is used can be calculated as below.

Mass of aspartic acid formed (mg)=1.01*Mass_mg of (aparagine in Asparaginase treated tobacco plug-asparagine in process control)

Mass of Ammonia ($NH_3$) formed (mg) =0.13*Mass_mg of (aparagine in Asparaginase treated tobacco plug-aparagine in process control)

Figure 13:
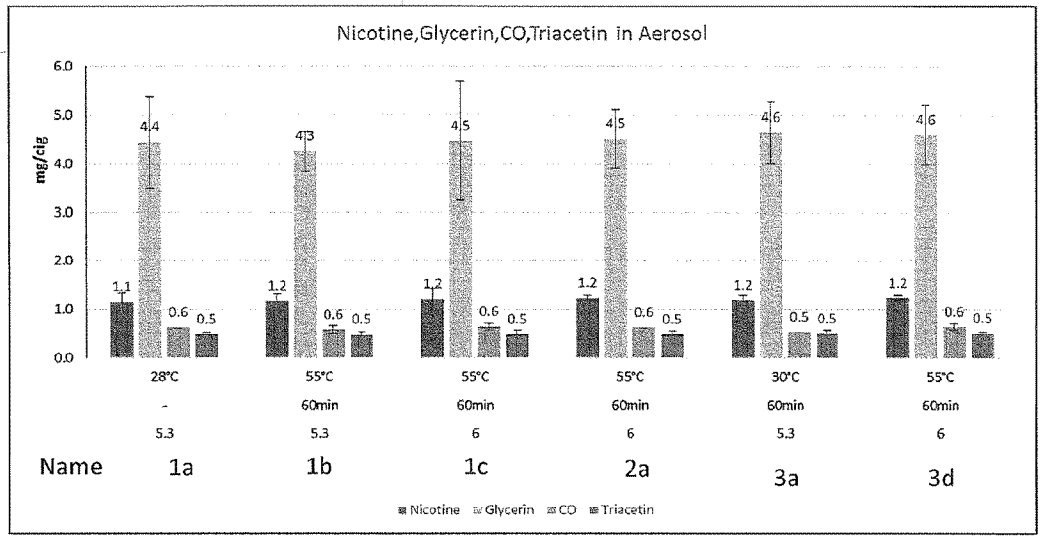
FIG. 13 shows the amount of nicotine, triacetin, glycerine and CO in the aerosol generated by heating samples of aerosol-former devices obtained including a component prepared from the homogenized tobacco material of the invention and from samples obtained not according to the invention.

The results are summarized in FIG. 13 for the amount of Nicotine, Glycerine, CO and triacetine delivery for some reference/process and samples according to the invention. FIG. 13 shows the amount of Nicotine, Glycerin, CO and Triacetin present in the aerosol formed by aerosol-generating articles fabricated using a component fabricated using the homogenized tobacco material casted using the slurry of reference samples 1a, 1b, 1c, or the slurry of process samples 2a, and of the samples of the invention 3a and 3d. The amount shown is represented as milligrams per "cig", that is milligrams per single article. As visible, there is no noticeable difference among the different samples.

Figure 9:
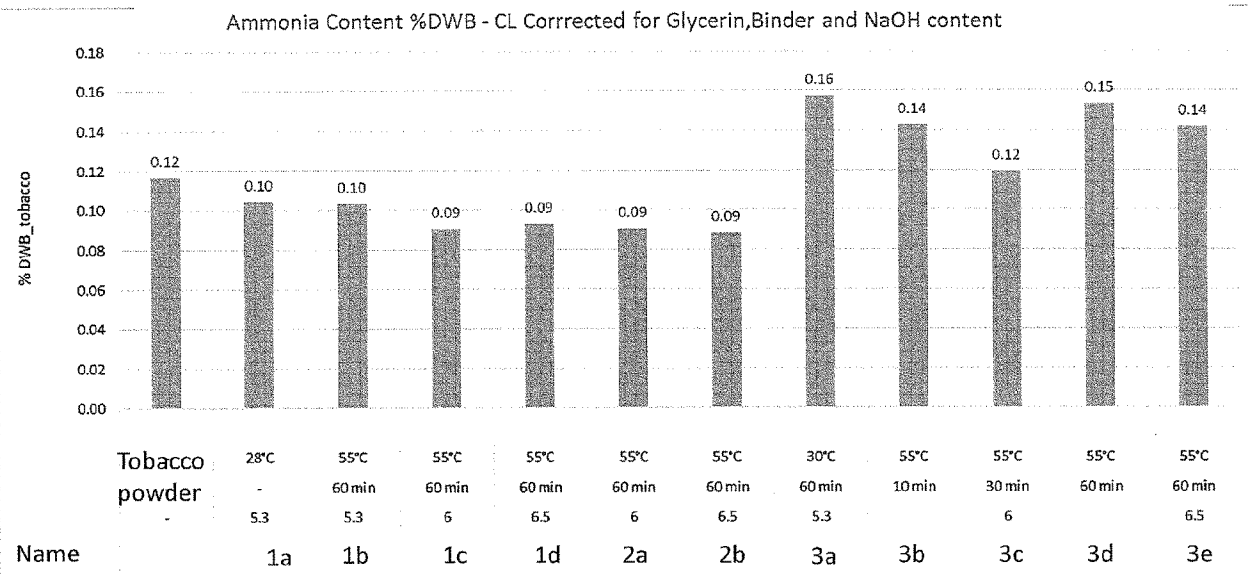
FIG. 9 shows the amount of ammonia in dry weight basis present in the homogenized tobacco material in different samples realized according to the invention and in control samples.

FIG. 9 shows the ammonia content in dry weight basis of the homogenized tobacco material of all examples 1a-c, 2a-b and 3a-e. It is clear that the samples of the invention 3a-3e including active asparaginase enzyme has a higher ammonia content.

The main difference between the homogenized tobacco material with or without (active) asparaginase addition lies also in the amount of aspartic acid and asparagine present in the homogenized tobacco material. The results are summarized in Table 5.

TABLE 5

| | | | | | mg Free AA/g tobacco powder (DWB) Corrected for Glycerin and Binder content | | | | | | | |
|---|---|---|---|---|---|---|---|---|---|---|---|---|
| Enzyme | pH_Target | Name | Time (min) | Temperature ° C. | Alanine | Aminobutyric acid | Arginine | Asparagine | Aspartic acid | Glutamic acid | Glutamine | Glycine |
| Tobacco Powder | — | | — | — | 0.92 | 0.36 | 1.16 | 4.93 | 2.42 | 0.70 | 1.25 | 0.11 |
| NO | 5.3 | 1a | — | 28 | 0.91 | 0.34 | 1.14 | 4.65 | 2.39 | 0.67 | 1.11 | 0.11 |
| Enzyme | 5.3 | 1b | 60 | 55 | 0.95 | 0.35 | 1.20 | 4.63 | 2.44 | 0.71 | 1.08 | 0.11 |
| | 6 | 1c | 60 | 55 | 0.96 | 0.36 | 1.21 | 4.61 | 2.52 | 0.73 | 1.10 | 0.11 |
| | 6.5 | 1d | 60 | 55 | 0.89 | 0.33 | 1.11 | 4.39 | 2.42 | 0.70 | 0.92 | 0.10 |
| Inactive | 6 | 2a | 60 | 55 | 0.91 | 0.34 | 1.15 | 4.41 | 2.48 | 0.71 | 1.00 | 0.11 |
| Enzyme | 6.5 | 2b | 60 | 55 | 0.89 | 0.33 | 1.09 | 4.39 | 2.41 | 0.71 | 0.93 | 0.11 |
| Active | 5.3 | 3a | 60 | 30 | 0.94 | 0.34 | 1.27 | 0.14 | 7.12 | 0.72 | 0.92 | 0.11 |
| Enzyme | 6 | 3b | 10 | 55 | 0.95 | 0.35 | 1.26 | 0.12 | 7.11 | 0.72 | 1.00 | 0.11 |
| | 6 | 3c | 30 | 55 | 0.94 | 0.35 | 1.26 | 0.10 | 7.16 | 0.74 | 0.99 | 0.11 |
| | 6 | 3d | 60 | 55 | 0.99 | 0.37 | 1.33 | 0.06 | 7.34 | 0.79 | 0.97 | 0.11 |
| | 6.5 | 3e | 60 | 55 | 0.95 | 0.36 | 1.27 | 0.09 | 7.13 | 0.76 | 0.97 | 0.11 |

Figure 8:
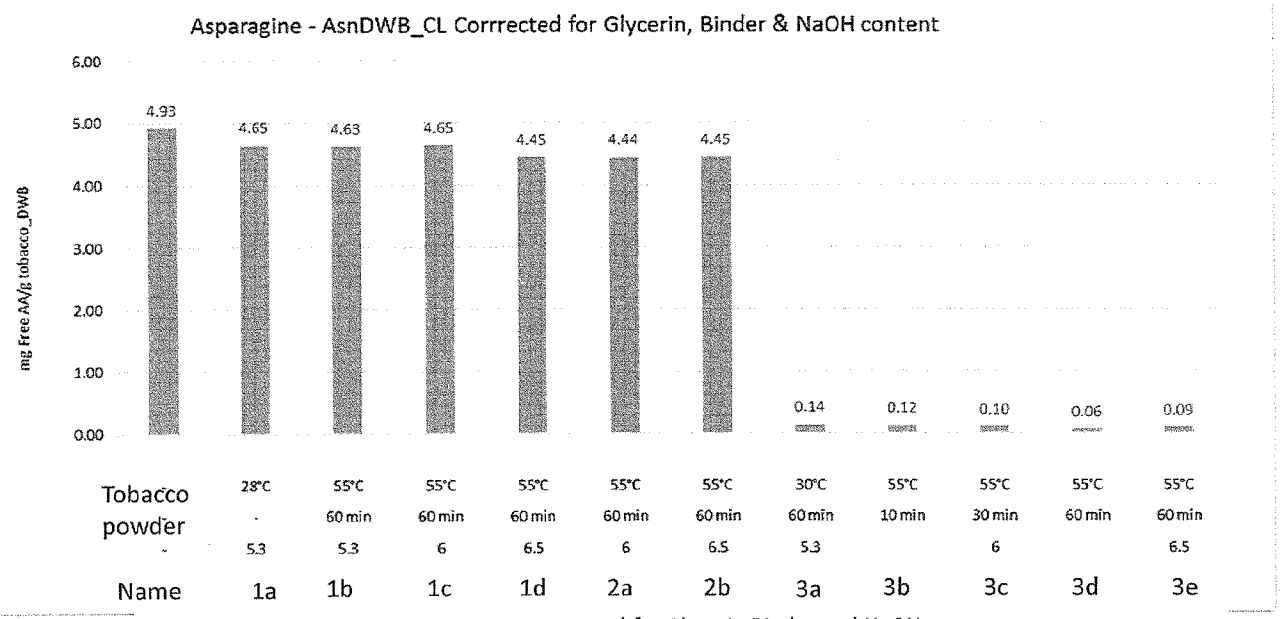
FIG. 8 shows the amount of asparagine in dry weight basis present in the homogenized tobacco material in different samples realized according to the invention and in control samples.

The amount of asparagine decreases in all examples realized according to the invention 3a-3e. The decrease in asparagine is equal or above 97 percent the asparagine present in a sample without enzyme or with an inactive enzyme. The variation in asparagine is depicted in FIG. 8, where the amount of asparagine in milligrams per gram of homogenized tobacco material in dry weight basis is shown. Consequently to the decrease in asparagine, there is an increase in aspartic acid in those samples including active asparaginase.

6% reduction in the asparagine content of the homogenized tobacco material takes place during production of cast leaf. Process control with no added asparaginase enzyme also shows the same reduction, showing that change in temperature or pH of slurry to 6/6.5 does not induce any change in the asparagine utilization. Similar reduction is observed in the process control with inactive asparaginase.

For all homogenized tobacco material preparations treated with active asparaginase, between about 97 percent and about 99 percent reduction is observed in the asparagine content of tobacco in cast leaf (FIG. 8). Enzymatic treatment for about 60 minutes at about pH 6 and slurry temperature of about 55 degrees Celsius shows the highest reduction.

Figure 14:
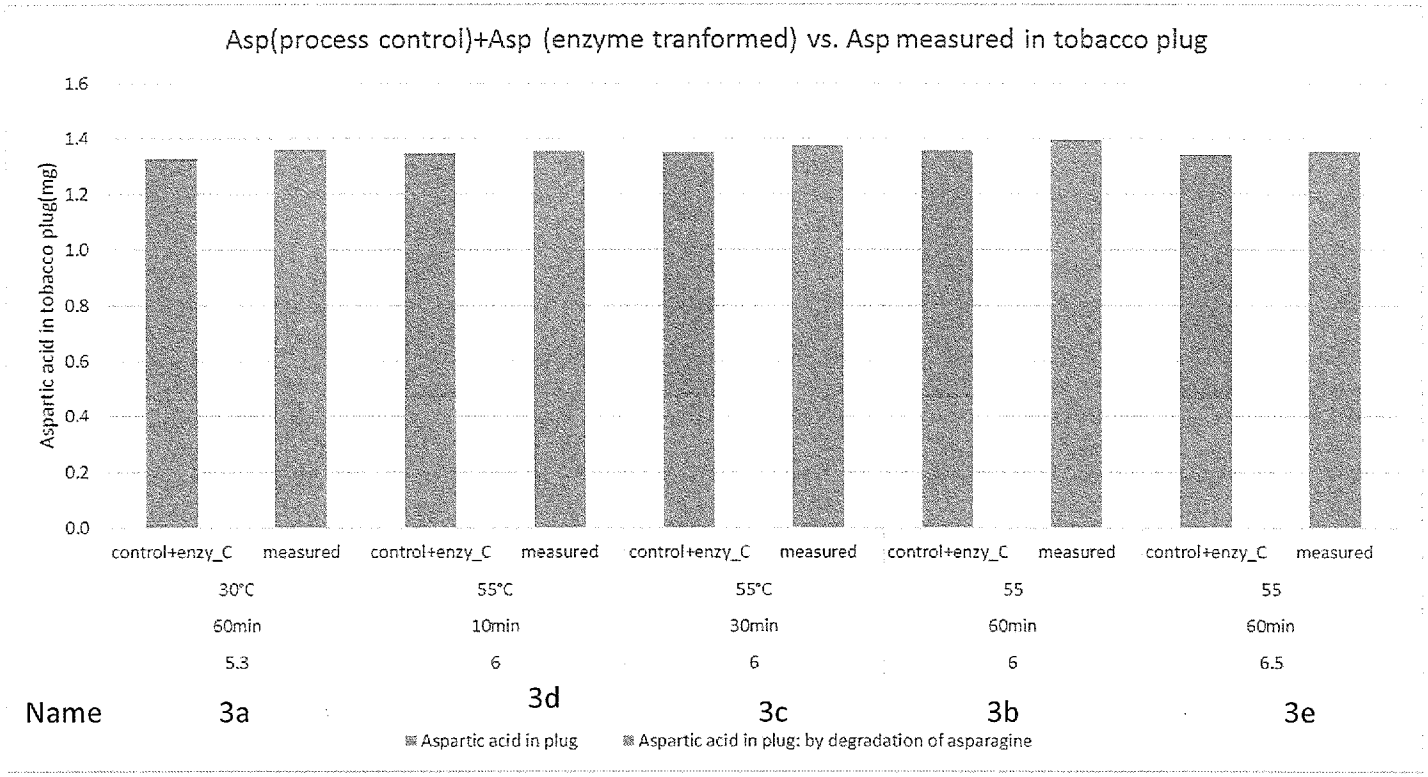
FIG. 14 shows the aspartic acid content of samples treated with asparaginase calculated vs. measured.

No change in the aspartic acid content of tobacco takes place during production of cast leaf, that is during casting and drying of the homogenized tobacco material produced with the slurry of the invention. No remarkable changes are observed in the process control cast leaf. About 200 percent increase in aspartic acid is observed in aspartic acid content of homogenized tobacco material samples treated with active asparaginase (FIG. 14). Enzymatic treatment for about 60 minutes at pH of about 6 and slurry temperature of about 55 degrees Celsius provides the highest transformation. The increase in aspartic acid content of cast leaf can be explained by the stoichiometric transformation of L-asparagine+$H_2O$⇆L-aspartate+$NH_3$. Indeed FIG. 14 compares the measured value of aspartic acid in the various samples 3a-3e according to the invention (right column for each sample) vs the calculated amount (left column) using the stoichiometric transformation above written.

Prototypes of smoking articles using the homogenized tobacco sheet according to the invention have been prepared and tested as well.

In these articles the following characteristics have been tested.

Figure 10:
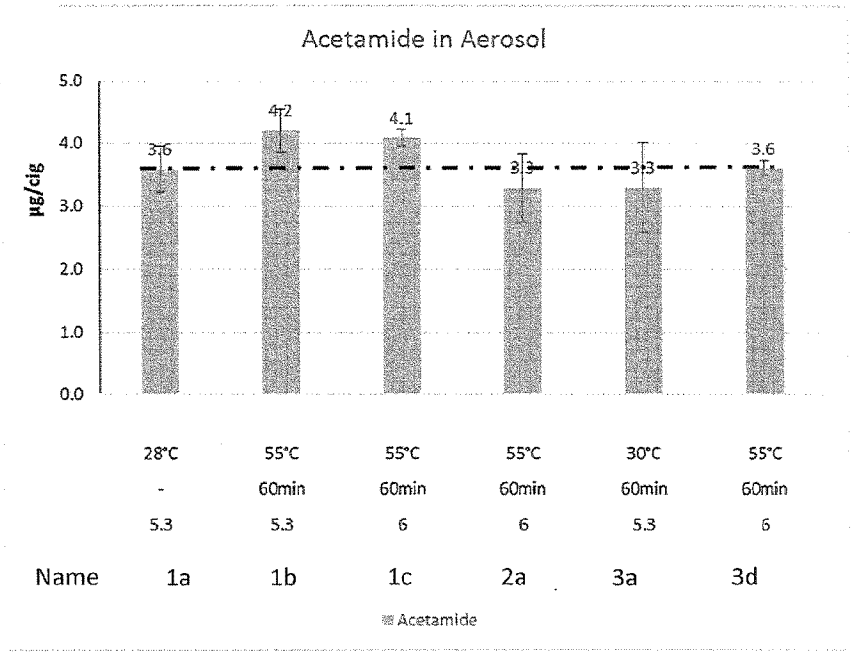
FIG. 10 shows the amount of acrylamide in the aerosol generated by heating samples of aerosol-former devices obtained including a component prepared from the homogenized tobacco material of the invention and from samples obtained not according to the invention.

Acrylamide content. No remarkable variation is observed between the acrylamide content of reference examples (no asparaginase) and process control examples (inactive asparaginase). About 71 percent reduction is observed in acrylamide content of aerosol from asparaginase treated prototypes compared to the reference samples (FIG. 10). The residual acrylamide in aerosol from the asparaginase treated products (depicted examples 3a and 3d) may be explained by formation of asparagine from peptides during the smoking run or by the presence of other precursors for acrylamide in the slurry.

Figure 11:
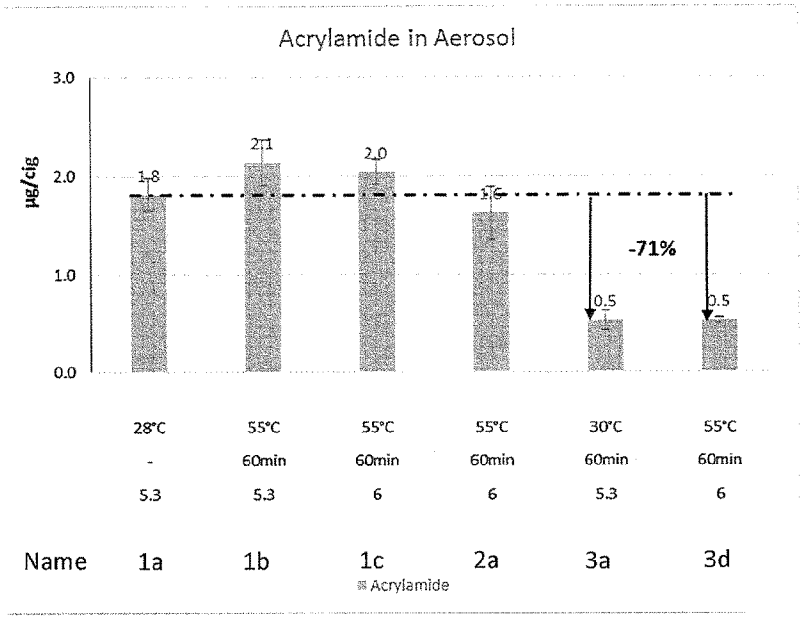
FIG. 11 shows the amount of acetamide in the aerosol generated by heating samples of aerosol-former devices obtained including a component prepared from the homogenized tobacco material of the invention and from samples obtained not according to the invention.
Figure 12:
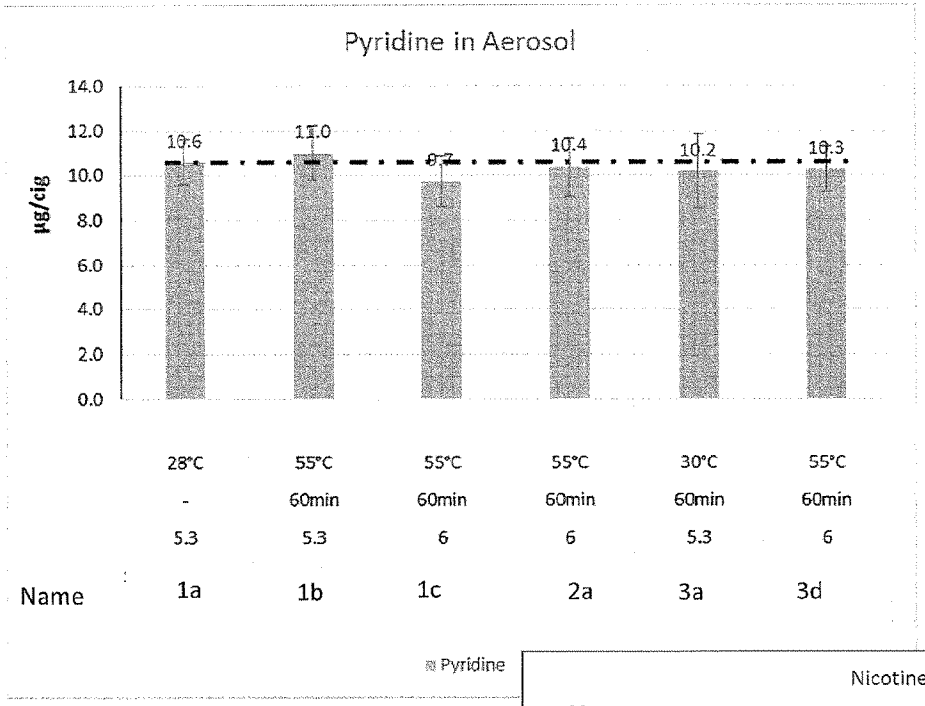
FIG. 12 shows the amount of pyridine in the aerosol generated by heating samples of aerosol-former devices obtained including a component prepared from the homogenized tobacco material of the invention and from samples obtained not according to the invention.

Nitrogen containing constituents, in particular acetamide and pyridine content. No remarkable variation was observed in Acetamide and Pyridine content of aerosol from process control/asparaginase treated prototypes compared to the reference and process ones (FIGS. 11 and 12). An increase of Aspartic acid or ammonia does not influence the concentration of these constituents.

The invention claimed is:

1. Method for the preparation of a homogenized tobacco material, said method comprising:

pulping and refining cellulose fibres to obtain fibres having a mean size per weight comprised between about 0.2 millimetres and about 4 millimetres;

grinding a blend of tobacco of one or more tobacco types to tobacco particles having a mean size per weight comprised between about 0.03 millimetres and about 0.12 millimetres;

combining the cellulose fibres with the tobacco particles and with a binder to form a slurry;

homogenizing the slurry;

adding asparaginase to the slurry in an amount comprised between about 0.0012 percent and about 0.02 percent per weight on dry weight basis of said homogenized tobacco material; and forming the homogenized tobacco material from the slurry, wherein the homogenized tobacco material comprises from about 50 percent and about 93 percent in dry weight basis of the tobacco particles and wherein the homogenized tobacco material comprises between about 1 percent and about 5 percent per weight on dry weight basis of the binder.

2. Method according to claim 1, wherein the slurry has a temperature comprised between about 20 degrees Celsius and about 60 degrees Celsius while the asparaginase is added.

3. Method according to claim 2, wherein the slurry is maintained at a temperature comprised between about 20 degrees Celsius and about 60 degrees Celsius for a time interval comprised between about 2 minutes and about 60 minutes between the addition of the asparaginase and the formation of the homogenized tobacco material.

4. Method according to claim 1, wherein the slurry has a pH comprised between about 5 and about 7 while the asparaginase is added.

5. Method according to claim 1, wherein an aerosol-former is added to the slurry and wherein the homogenized tobacco material comprises between about 5 percent and about 30 percent in dry weight basis of an aerosol-former.

6. Method according to claim 1, wherein the step of forming a homogenized tobacco material from the slurry comprises the steps of:

casting a web of the slurry; and drying said cast web.

7. Method according to claim 6, including the step of:

cooling said slurry to a temperature below about 15 degree Celsius before casting said slurry.

8. Method according to claim 1, wherein said step of grinding tobacco of one or more tobacco types comprises grinding one or more of the following tobaccos:

Bright tobacco;

Dark tobacco;

Aromatic tobacco;

Filler tobacco.

9. Aerosol-generating article, comprising a component prepared from the method of claim 1.

10. A homogenized tobacco material comprising:

between about 1 percent and about 7 percent per weight on a dry weight basis of cellulose fibres, the cellulose fibres having a mean length per weight comprised between 0.2 millimetres and about 4 millimetres;

tobacco particles having a mean particle size per weight between about 0.03 millimetres and about 0.12 millimetres and in an amount comprised between about 50 percent and about 93 percent per weight on a dry weight basis;

between about 1 percent and about 5 percent per weight on a dry weight basis of a binder;

asparaginase an amount comprised between about 0.0012 percent and about 0.02 percent per weight on dry weight basis of said homogenized tobacco material; and water.

11. Homogenized tobacco material according to claim 10, comprising between about 5 percent and about 30 percent in dry weight basis of an aerosol-former.

12. Homogenized tobacco material according to claim 10, comprising aspartic acid.

13. Homogenized tobacco material according to claim 10, being solid and preferably in a form of a sheet.

14. Aerosol-generating article, comprising a component prepared from the homogenised tobacco material of claim 10.

* * * * *